US011274479B2

(12) United States Patent
Nestor et al.

(10) Patent No.: US 11,274,479 B2
(45) Date of Patent: Mar. 15, 2022

(54) HEAVY-DUTY JAMB LATCH FOR SLIDING BUILDING DOORS

(71) Applicant: Metal Works, Inc., Spencer, IA (US)

(72) Inventors: Patrick Michael Nestor, Richmond, MN (US); Philip Lloyd Ramstack, Spencer, IA (US); Jay Edward Osman, Milford, IA (US); Kevin August Kupka, Spencer, IA (US); Norma Gabriela Granados Raya, Spirit Lake, IA (US)

(73) Assignee: Metal Works, Inc., Spencer, IA (US)

( * ) Notice: Subject to any disclaimer, the term of this patent is extended or adjusted under 35 U.S.C. 154(b) by 646 days.

(21) Appl. No.: 15/994,701

(22) Filed: May 31, 2018

(65) Prior Publication Data

US 2019/0368245 A1 Dec. 5, 2019

(51) Int. Cl.
*E05C 19/14* (2006.01)
*E05B 65/08* (2006.01)

(52) U.S. Cl.
CPC ..... *E05C 19/14* (2013.01); *E05B 65/08* (2013.01)

(58) Field of Classification Search
CPC ..... E05C 19/14; E05C 19/10; E05C 19/12; E05C 19/105; E05C 17/46; E05C 3/06; E05C 3/043; E05C 3/30; E05C 5/00; E05B 65/08; E05B 65/0811; E05B 65/0835; E05B 65/0858; Y10T 292/0911; Y10T 292/0949; Y10T 292/1039; Y10T 292/0825; Y10T 292/0831; Y10T 292/0832
See application file for complete search history.

(56) References Cited

U.S. PATENT DOCUMENTS 1,566,470 A * 12/1925 Flatley ..... E05C 17/50 292/56
2,921,810 A * 1/1960 Smith ..... E05C 19/145 292/113
2,998,272 A * 8/1961 Newcomer, Jr. ..... E05C 19/14 292/66
3,146,011 A * 8/1964 Seevers ..... E05C 19/14 292/247
3,237,978 A * 3/1966 Swanson ..... E05C 19/14 292/113

(Continued)

FOREIGN PATENT DOCUMENTS

GB 2083123 A * 3/1982 ..... E05C 19/14

*Primary Examiner* — Christine M Mills
*Assistant Examiner* — Christopher F Callahan
(74) *Attorney, Agent, or Firm* — McKee, Voorhees & Sease, PLC

(57) ABSTRACT

A heavy-duty jamb latch for securing sliding doors to a rough opening of a building or structure includes a base plate, a handle, side plates adjacent and pivotably connected to the base plate, a carrier pin passing through recesses in the base plate and apertures in the side plates, and rigid members fastened to the carrier pin via bores drilled into the carrier pin. The rigid members extend away from the handle and secure sliding doors to a rough opening of a building or structure. The heavy-duty jamb latch may be mounted to the rough opening of the building or structure and may transition from an open position to a closed position by pulling the handle, thereby securing the sliding doors to the rough opening of the building or structure. Additionally, a locking pin or a padlock may lock the heavy-duty jamb latch.

19 Claims, 28 Drawing Sheets

(56) References Cited

U.S. PATENT DOCUMENTS

| | | | | | |
|---|---|---|---|---|---|
| 4,098,530 | A * | 7/1978 | Edeus | E05B 65/0817 | 292/113 |
| 5,165,148 | A * | 11/1992 | Fleischer | B25B 5/12 | 24/494 |
| 5,667,261 | A * | 9/1997 | Weinerman | E05C 19/14 | 292/113 |
| 6,561,556 | B2 * | 5/2003 | Fuchs | B65D 45/345 | 292/113 |
| 7,448,656 | B1 * | 11/2008 | Hein | E05C 19/145 | 244/129.4 |
| 9,713,275 | B2 * | 7/2017 | Chen | H05K 5/0221 | |
| 2005/0077736 | A1 * | 4/2005 | Hagan | E05C 19/14 | 292/247 |
| 2006/0076785 | A1 * | 4/2006 | Eriksson | E05C 19/14 | 292/247 |
| 2007/0018372 | A1 * | 1/2007 | Sun | B25B 5/12 | 269/228 |
| 2007/0214615 | A1 * | 9/2007 | Hagan | B25B 5/12 | 24/494 |
| 2014/0069154 | A1 * | 3/2014 | Dolev | E05C 9/046 | 70/108 |

* cited by examiner

HEAVY-DUTY JAMB LATCH FOR SLIDING BUILDING DOORS

FIELD OF THE INVENTION

The present disclosure relates generally to an apparatus and method for securing sliding building doors. More particularly, the present disclosure relates to a heavy-duty jamb latch.

BACKGROUND OF THE INVENTION

As the use of farm equipment and the size of farm equipment continues to increase, storage buildings and sliding doors have become larger to accommodate these increases.

To date, no manufacturers have produced a cam over jamb latch to work with these demanding applications. Currently, storage buildings and sliding doors typically use a smaller standard latch as the only means to hold the doors secure. Some businesses and farmers use more than one of these latches per door for security. Still they lack a true sense of security because the smaller latch compromises the ability of the doors due to not being able to withstand the increased loads derived from having larger doors.

Thus, there exists a need in the art for a more robust cam over jamb latch capable of withstanding increased loads associated with larger sliding building doors to allow secure latching of heavier doors.

BRIEF SUMMARY OF THE INVENTION

Therefore, it is a primary object, feature, or advantage of the invention to improve on or overcome the deficiencies in the art.

It is another object, feature, or advantage of the invention to provide several different embodiments for a heavy-duty jamb latch which dissipates loads in at least two dimensions.

It is still yet a further object, feature, or advantage of the invention to provide a heavy-duty jamb latch that is usable for a wide variety of applications.

It is still yet a further object, feature, or advantage of the invention to provide a heavy-duty jamb latch that improves the safety and security of livestock, feed for livestock, agricultural machinery, and other farming equipment.

It is still yet a further object, feature, or advantage of the invention to provide a heavy-duty jamb latch that is cost effective and commercially viable within the post frame industry.

It is still yet a further object, feature, or advantage of the invention to provide a heavy-duty jamb latch that is reliable and durable.

It is still yet a further object, feature, or advantage of the invention to provide a heavy-duty jamb latch that is easy and intuitive to use.

It is still yet a further object, feature, or advantage of the invention to provide a heavy-duty jamb latch that can be easily manufactured, installed, and disassembled for repair or service.

It is still yet a further object, feature, or advantage of the invention to provide a heavy-duty jamb latch that is aesthetically pleasing.

According to some aspects of the disclosure, a first heavy-duty jamb latch includes a base plate, a handle, side plates adjacent and pivotably connected to the base plate, a carrier pin passing through recesses in the base plate and apertures in the side plates, and hook-shaped struts fastened to the carrier pin via bores drilled into the carrier pin. The hook-shaped struts extend away from the handle and are configured to latch onto a mounting bracket assembly comprising latching posts, pegs, or knobs that can be used with steel box girts or 2×4 wood laterals.

According to additional aspects of the disclosure, an approximate seventy-five-degree radial bend of the hook-shaped struts allows the hook-shaped struts to latch onto a mounting bracket assembly comprising latching posts, pegs, or knobs that can be used with steel box girts or 2×4 wood laterals.

According to additional aspects of the disclosure, threads in the hook-shaped struts and nuts fasten the hook-shaped struts to the carrier pin.

According to additional aspects of the disclosure, the first heavy-duty jamb latch may be used in combination with the box girt mounting bracket and a box girt.

According to other aspects of the disclosure, a second embodiment of a heavy-duty jamb latch includes a base plate, a handle, side plates adjacent and pivotably connected to the base plate, a carrier pin passing through recesses in the base plate and apertures in the side plates, and rods fastened to the carrier pin via bores drilled into the carrier pin. The rods extend away from the handle and are configured to receive a boot that engages an alcove of a rail.

According to additional aspects of the disclosure, the rods are about ninety-degree rods and threads in the about ninety-degree rods and nuts fasten the about ninety-degree rods to the carrier pin.

According to additional aspects of the disclosure, the second heavy-duty jamb latch may be used in combination with the boot and the rail, wherein the rail is a vertical rail.

According to additional aspects of the disclosure, the boot maintains three points of contact with the vertical rail, one of the three points of contact being located within the alcove of the vertical rail.

According to additional aspects of the disclosure, the boot preferably comprises aluminum, but may also comprise steel, plastic, or any other known material fit for use for its intended purpose.

According to other aspects of the disclosure, a generic embodiment of a heavy-duty jamb latch includes a base plate, a handle, side plates adjacent and pivotably connected to the base plate, a carrier pin passing through recesses in the base plate and apertures in the side plates, and rigid members fastened to the carrier pin via bores drilled into the carrier pin. The rigid members extend away from the handle and are configured to secure sliding doors to a jamb of a rough opening.

According to additional aspects of the disclosure, the generic heavy-duty jamb latch may be used in combination with another heavy-duty jamb latch to further secure the sliding doors to the jamb of the rough opening.

According to additional aspects of the disclosure, the first, second, or generic heavy-duty jamb latch may also include pin holes in the side plates and the base plate through which a locking pin or padlock is used to lock the heavy-duty jamb latch.

According to additional aspects of the disclosure, the base plate of the first, second, or generic heavy-duty jamb latch may also include openings for mounting the heavy-duty jamb latch.

According to additional aspects of the disclosure, the base plate of the first, second, or generic heavy-duty jamb latch may also include locating features or extensions to allow for easier installation of the heavy-duty jamb latch on to the jamb of the rough opening.

According to additional aspects of the disclosure, the handle of the first, second, or generic heavy-duty jamb latch may also include a handle pin removably attached to the side plates via fasteners.

According to other aspects of the disclosure, a method of securing sliding doors to a jamb of a rough opening includes providing a heavy-duty jamb latch having a base plate, a handle, side plates adjacent and pivotably connected to the base plate, and a carrier pin passing through recesses in the base plate and apertures in the side plates and securing the sliding doors to the jamb of the rough opening with rigid members of the heavy-duty jamb latch, said rigid members fastened to the carrier pin via bores drilled into the carrier pin and extending away from the handle.

According to additional aspects of the disclosure, the method may also include locking the heavy-duty jamb latch with a locking pin or a padlock via pin holes in the side plates and the base plate.

According to additional aspects of the disclosure, the method may also include mounting the heavy-duty jamb latch to the jamb of the rough opening.

According to additional aspects of the disclosure, securing the heavy-duty jamb latch comprises moving the handle from an open position to a closed position which causes the side plates to pivot about the base plate.

According to additional aspects of the disclosure, the side plates are substantially perpendicular to the base plate in the open position and the side plates are substantially parallel to the base plate in the closed position.

These or other objects, features, and advantages of the invention will be apparent to those skilled in the art. The invention is not to be limited to or by these objects, features and advantages. No single embodiment need provide each and every object, feature, or advantage.

Figure 1:
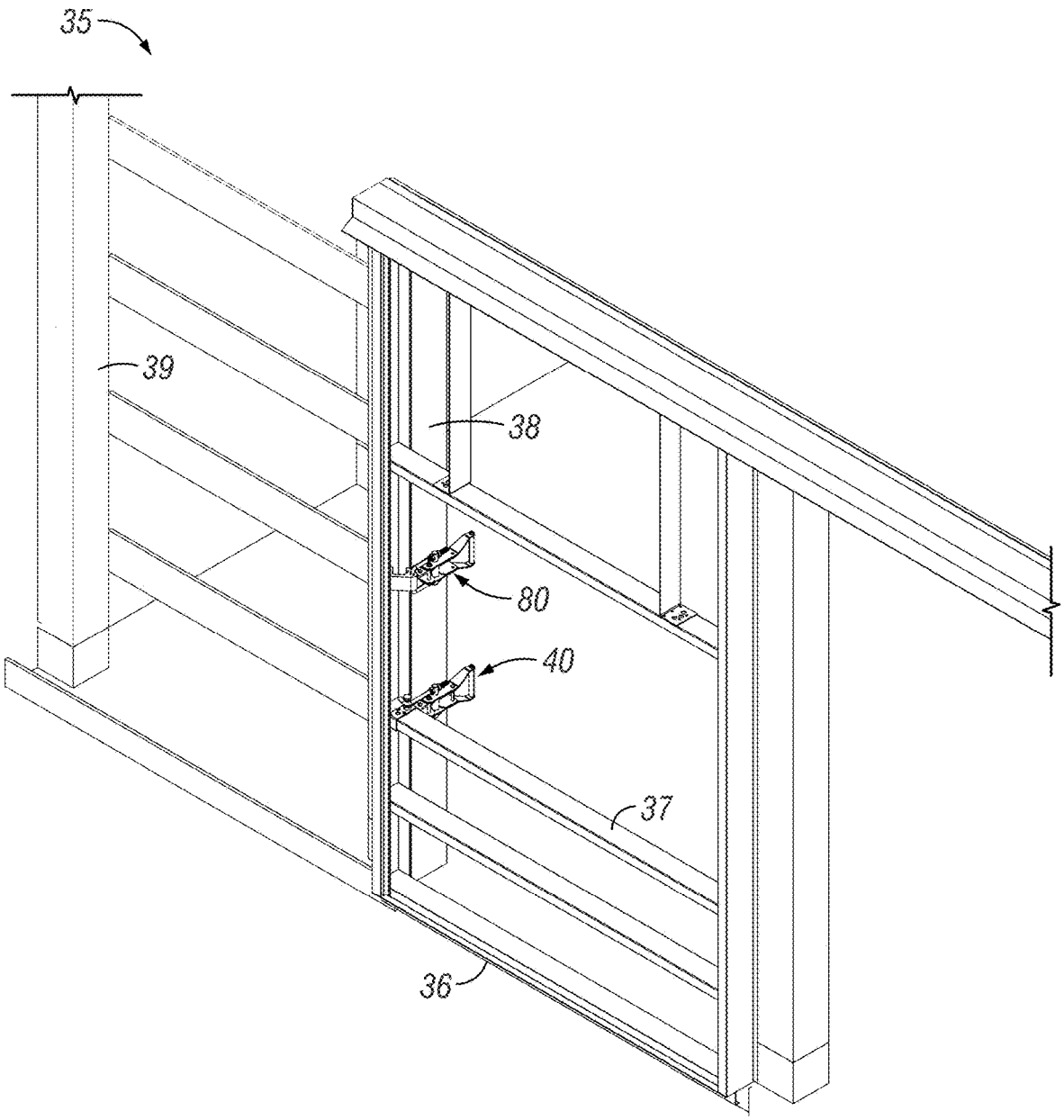
FIG. 1 shows a perspective view of a building or structure such as a barn having sliding doors secured by two different embodiments of a heavy-duty jamb latch, according to some aspects of the present disclosure.
Figure 2:
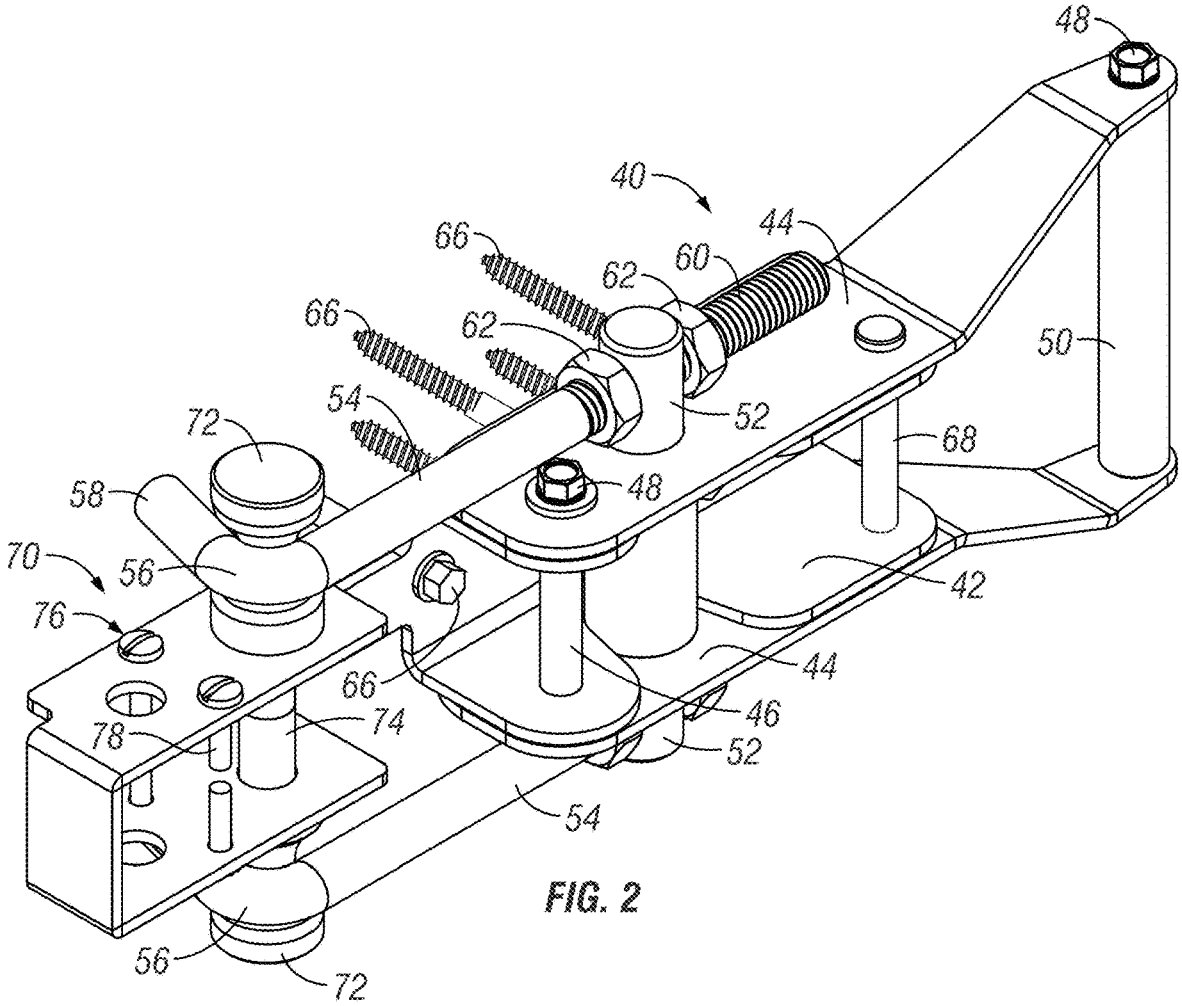
FIG. 2 shows a front, top perspective view of a heavy-duty jamb latch capable of attaching to two posts secured to a box girt of a sliding building or structure door, according to some aspects of the present disclosure.
Figure 3:
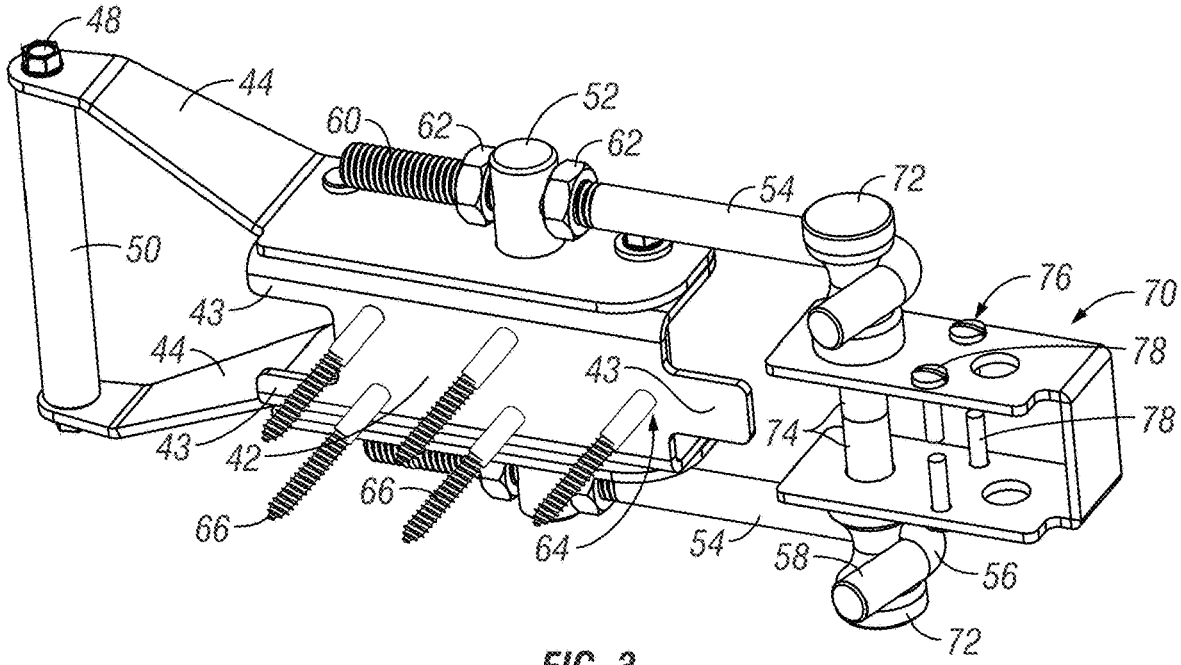
FIG. 3 shows a rear, top perspective view of the heavy-duty jamb latch of FIG. 2, according to some aspects of the present disclosure.
Figure 4:
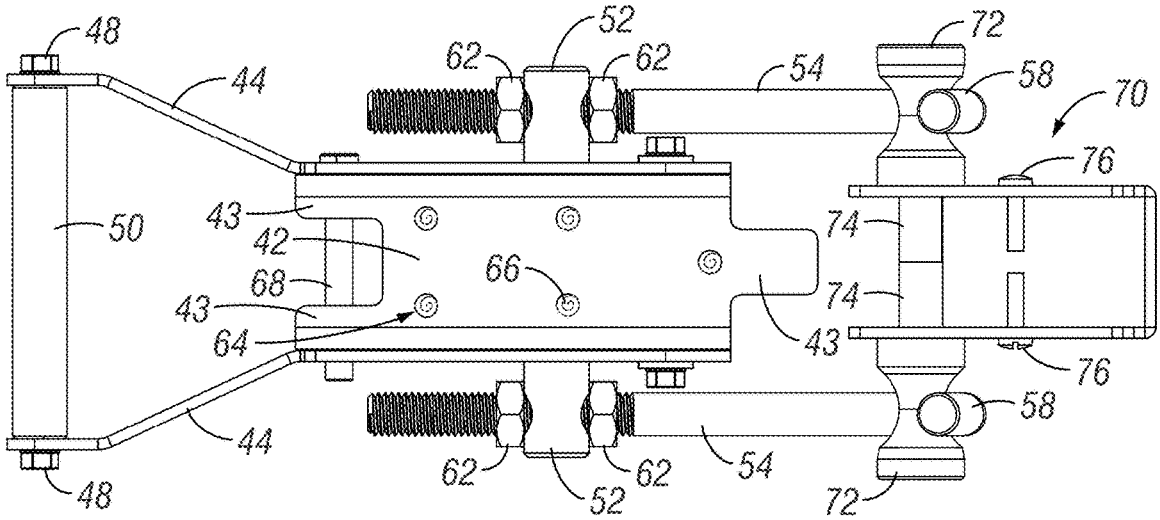
FIG. 4 shows a rear elevation view of the heavy-duty jamb latch of FIG. 2, according to some aspects of the present disclosure.
Figure 5:
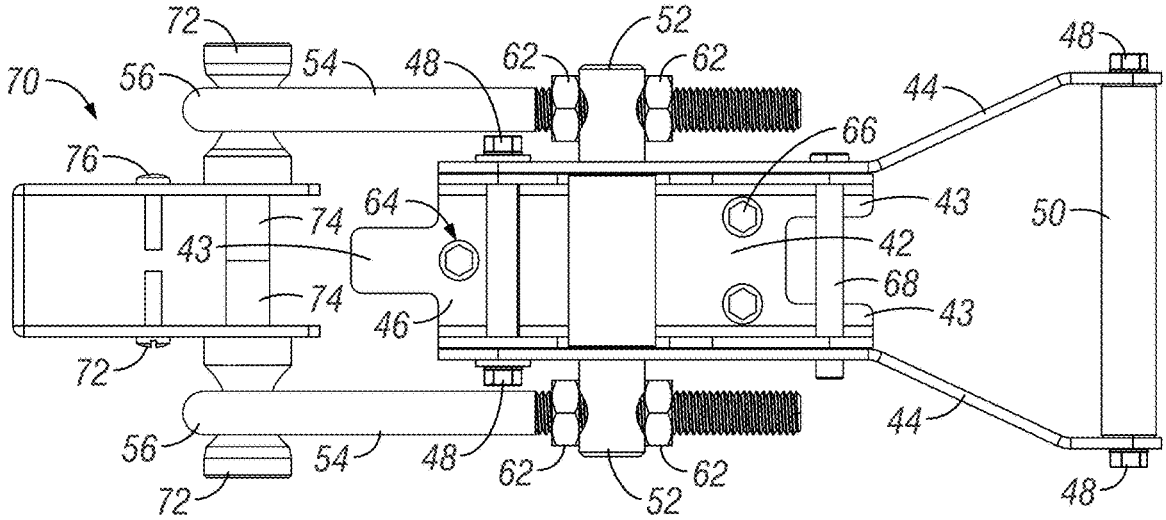
FIG. 5 shows a front elevation view of the heavy-duty jamb latch of FIG. 2, according to some aspects of the present disclosure.
Figure 6:
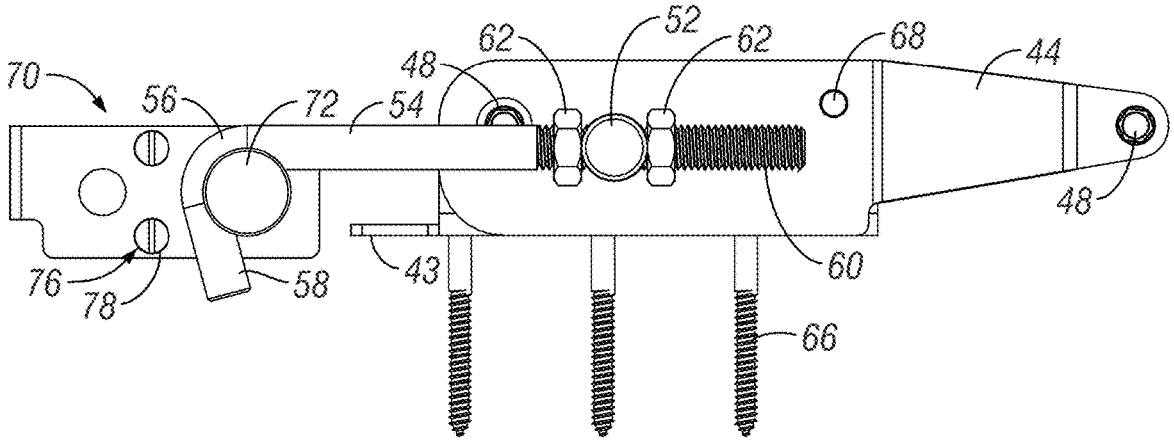
FIG. 6 shows a bottom elevation view of the heavy-duty jamb latch of FIG. 2, according to some aspects of the present disclosure.
Figure 7:
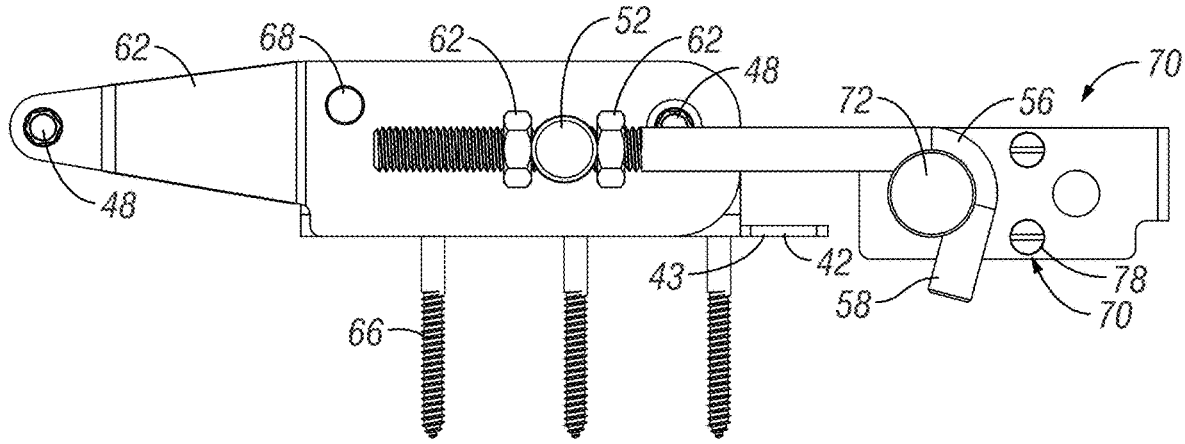
FIG. 7 shows a top elevation view of the heavy-duty jamb latch of FIG. 2, according to some aspects of the present disclosure.
Figure 8:
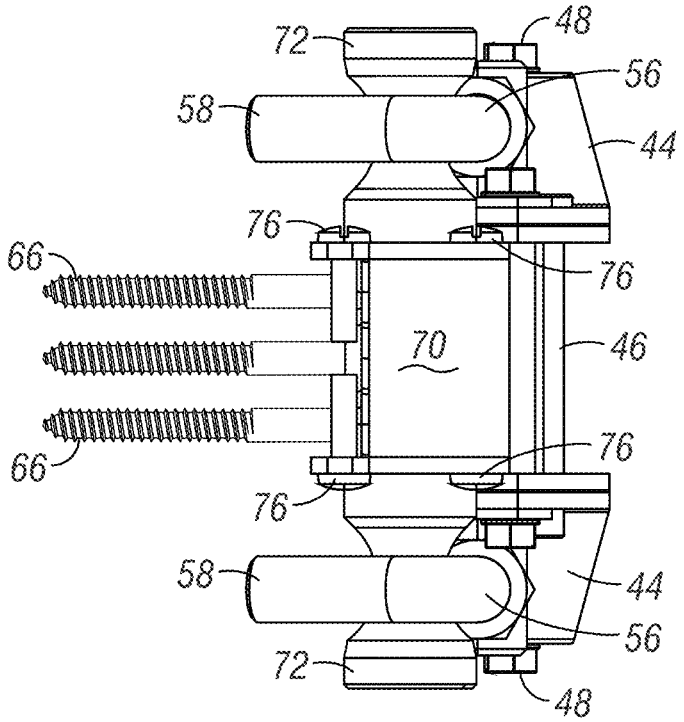
FIG. 8 shows a left elevation view of the heavy-duty jamb latch of FIG. 2, according to some aspects of the present disclosure.
Figure 9:
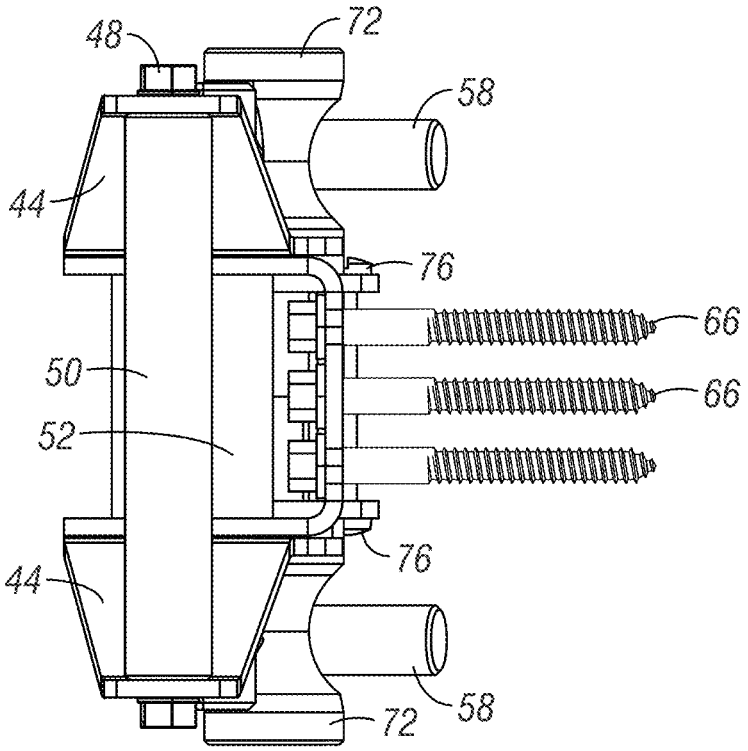
FIG. 9 shows a right elevation view of the heavy-duty jamb latch of FIG. 2, according to some aspects of the present disclosure.

Various embodiments of the invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION

The following definitions and introductory matters are provided to facilitate an understanding of the present invention.

The singular terms "a," "an," and "the" include plural referents unless context clearly indicates otherwise. Similarly, the word "or" is intended to include "and" unless the context clearly indicate otherwise. The word "or" means any one member of a particular list and also includes any combination of members of that list.

Reference is made to the accompanying drawings which form a part hereof, and in which is shown by way of illustration specific embodiments in which the invention may be practiced. These embodiments of the invention will be described in detail with reference to the drawings, wherein like reference numerals represent like parts throughout the several views. These embodiments are described in sufficient detail to enable those skilled in the art to practice the invention and it is to be understood other embodiments may be utilized. Mechanical, procedural, and other changes may be made without departing from the spirit and scope of the invention. The following detailed description is, therefore, not to be taken in a limiting sense, and the scope of the invention is defined only by the appended claims, along with the full scope of equivalents to which such claims are entitled.

As used herein, the terminology such as first, second, vertical, horizontal, top, bottom, upper, lower, front, rear, end, sides, concave, convex, and the like, are referenced according to the views presented. However, it should be understood the terms are used only for purposes of description and are not intended to be used as limitations. Accordingly, orientation of an object or a combination of objects may change without departing from the scope of the invention.

Finally, for purposes of the present disclosure, the term "cam" is defined as "a rotating or sliding piece in a mechanical linkage used especially in transforming rotary motion into linear motion." As is known from the art, a cam is typically a part of a rotating wheel (e.g. an eccentric wheel) or shaft (e.g. a cylinder with an irregular shape) that contacts a lever at one or more points on its circular path. The cam produces a smooth reciprocating (back and forth) motion in the lever (e.g. a handle). The term "jamb" is defined as "an upright piece or surface forming the side of an opening (as for a door, window, or fireplace)."

According to a non-limiting example of the present disclosure, FIG. 1 illustrates a building or structure 35 such as a barn having a sliding door 36 including box girts 37, a jamb 38 of a rough opening 39 of a building or structure, and two exemplary heavy-duty jamb latches 40, 80 configured to secure the sliding door 36 to the rough opening 39 of the building or structure.

The two exemplary heavy-duty jamb latches 40, 80 are able to secure and withstand loads of larger, heavier (e.g., three and a half inch thick) doors. Additionally, the two exemplary heavy-duty jamb latches 40, 80 include a cam over mechanism that is generated using a handle. Such a cam over mechanism is unique compared to other currently available latches and is advantageous because it dissipates loads in at least two dimensions, whereas known solutions in the art substantially dissipate loads only within a single line.

Referring now to FIGS. 2 to 9, a first exemplary heavy-duty jamb latch 40 includes a foundational body or base plate 42. The base plate 42 is a solid piece of material that has enough strength and sturdiness to serve as the surface to which other things are attached to be supported. Side plates 44 are pivotably attached and fastened to the base plate via a pivot pin 46 pivot pin and fasteners, such as hexagonal screws 48. The side plates 44 may include angled surfaces that recess towards or protrude away from (as is particularly shown in FIG. 2) the base plate 42 to allow for the handle pin 50 to span any desirable length. The fasteners, such as hexagonal screws 48, are also used to fasten a handle pin 50 at ends of the side plates.

In lieu of the fasteners, such as hexagonal screws 48, nuts, bolts, rivets, washers, any other known fastening mechanisms, or any combination thereof may be used to facilitate fastening. Additionally, the handle pin 50 may comprise a rubber material, knurling, specially shaped grooves, partially adhesive substances, any other materials known gripping mechanisms, or any combination thereof to facilitate gripping the handle.

Figure 10A:
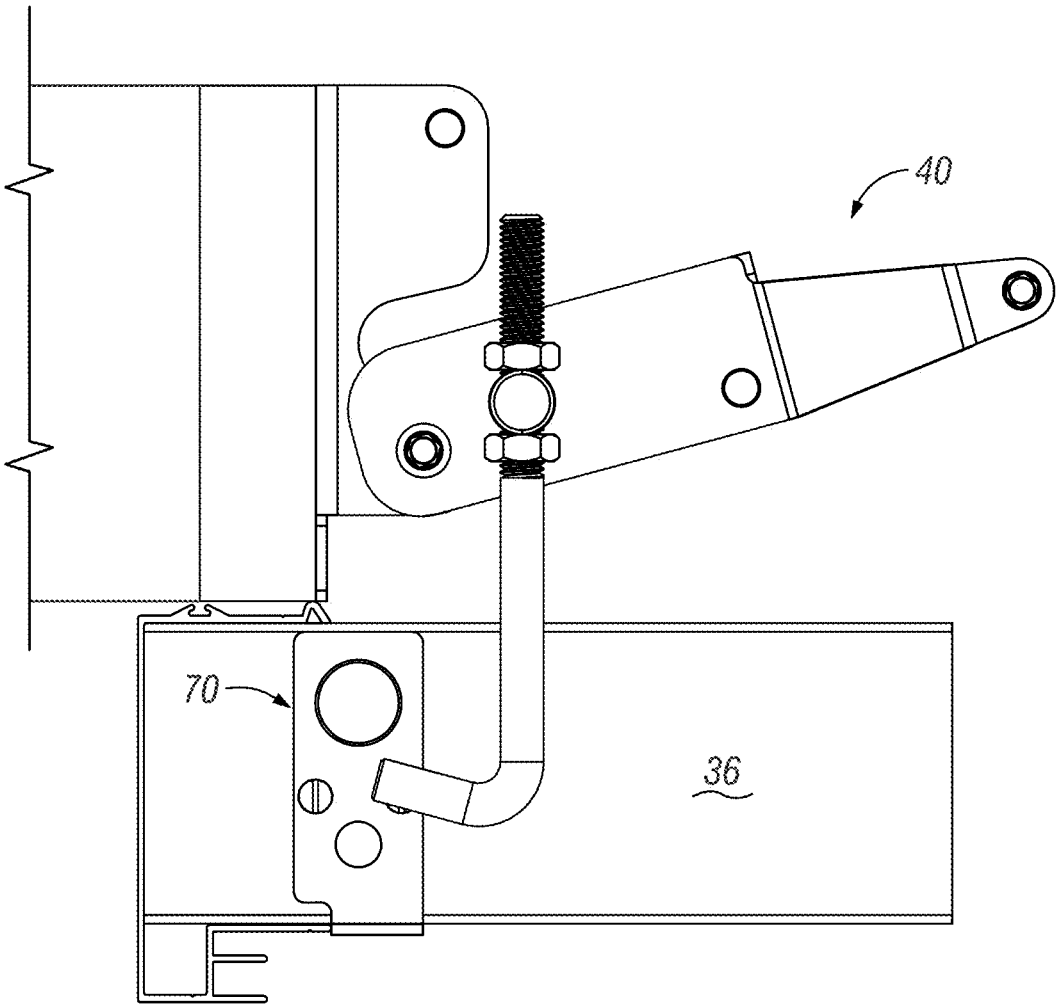
FIGS. 10A and 10B show a top elevation view and a top, front perspective view of the heavy-duty jamb latch of FIG. 2 in an open position and about to attach to two posts secured to a box girt of a sliding building or structure door, according to some aspects of the present disclosure.
Figure 10B:
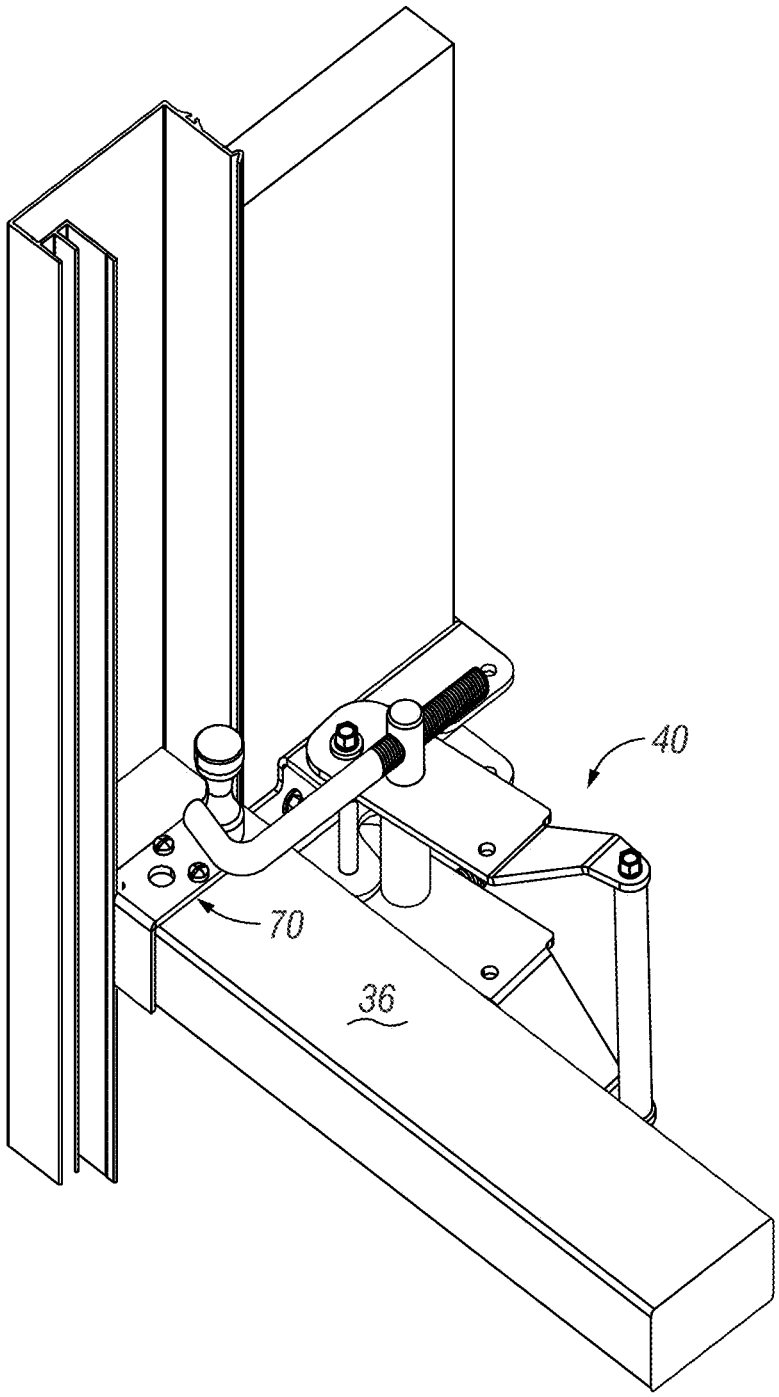
Figure 11A:
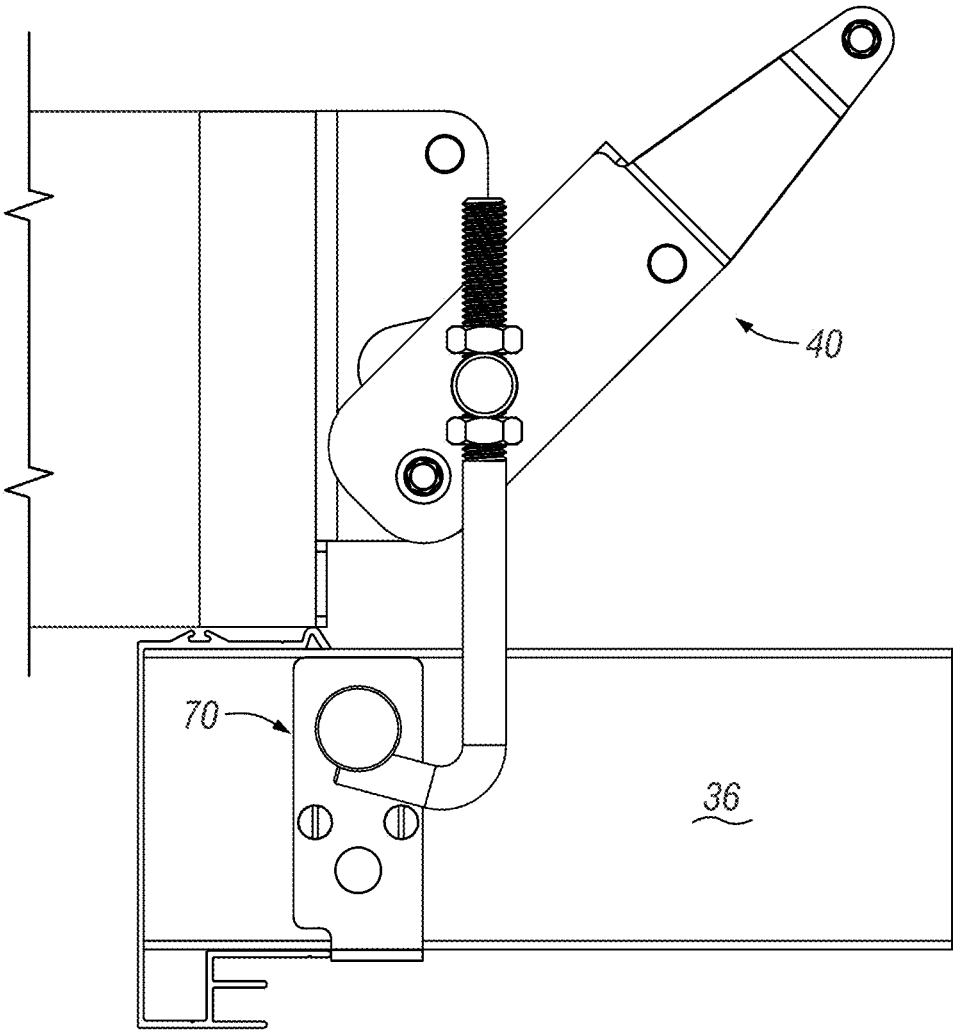
FIGS. 11A and 11B show a top elevation view and a top, front perspective view of the heavy-duty jamb latch of FIG. 2 in a partially open position and attaching to two posts secured to a box girt of a sliding building or structure door, according to some aspects of the present disclosure.
Figure 11B:
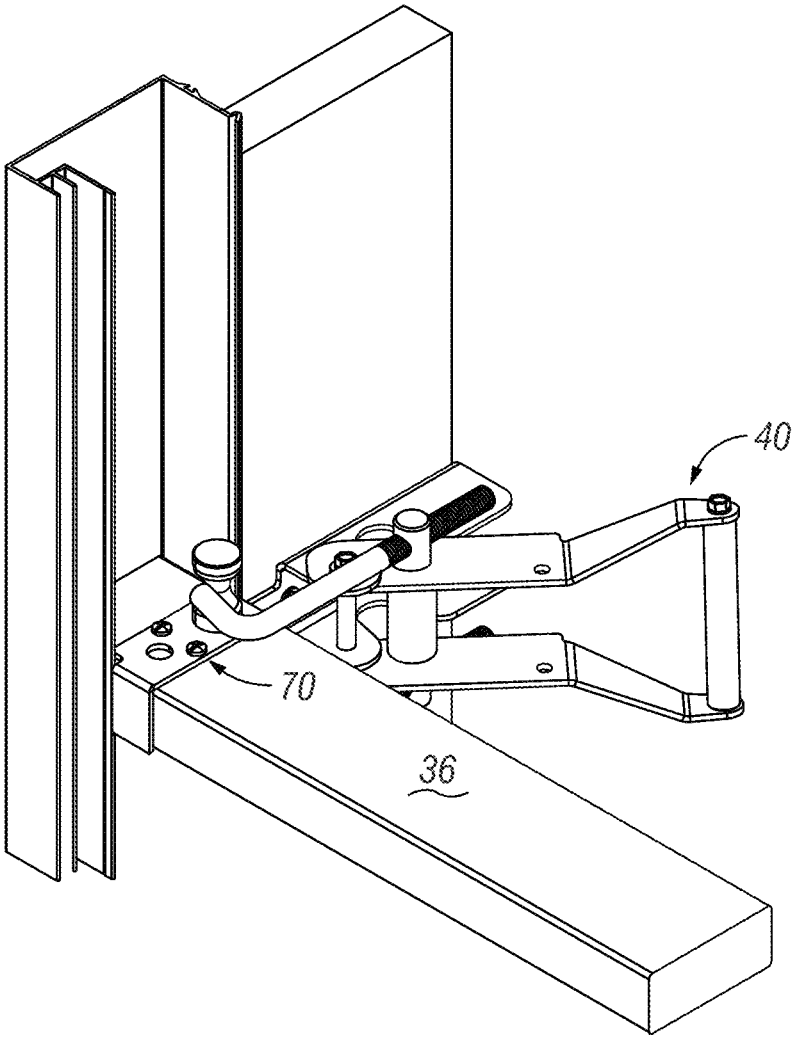
Figure 12A:
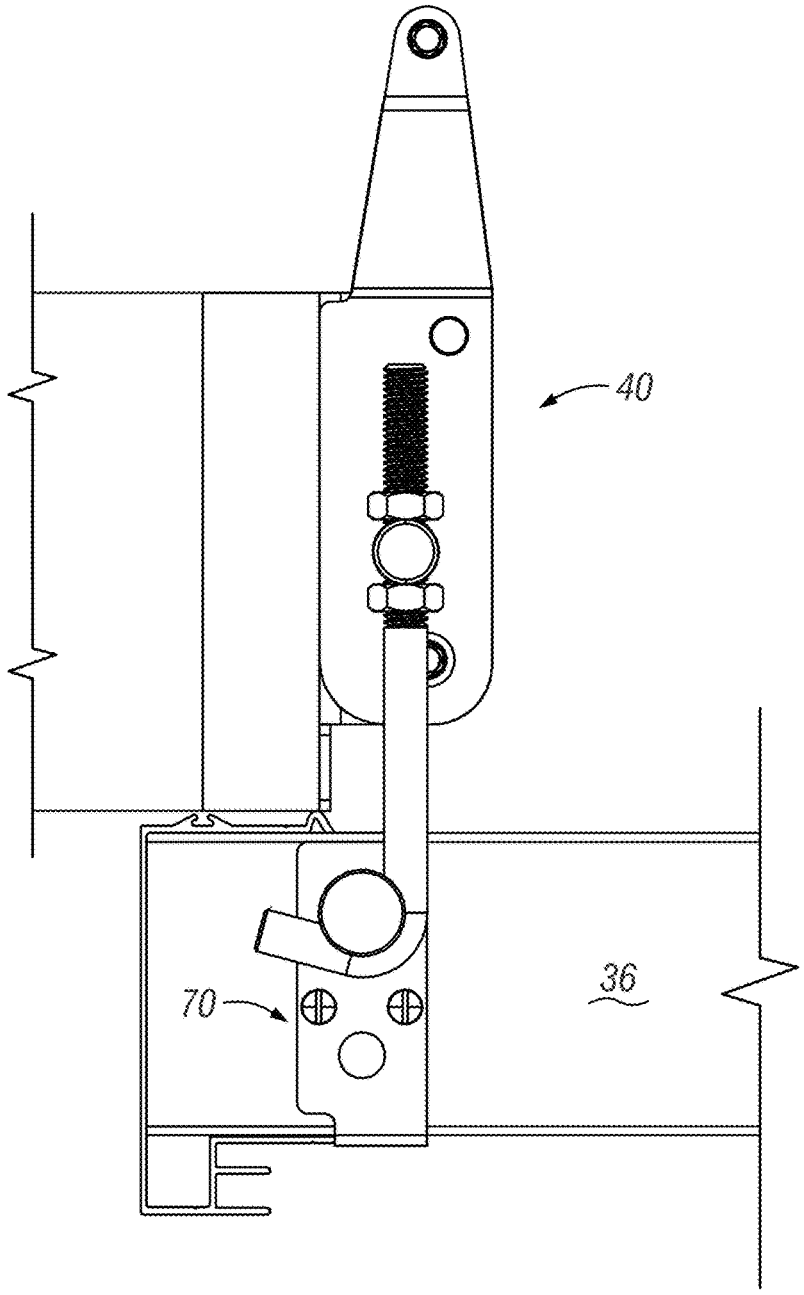
FIGS. 12A and 12B show a top elevation view and a top, front perspective view of the heavy-duty jamb latch of FIG. 2 in a closed position and attaching to two posts secured to a box girt of a sliding building or structure door, according to some aspects of the present disclosure.
Figure 12B:
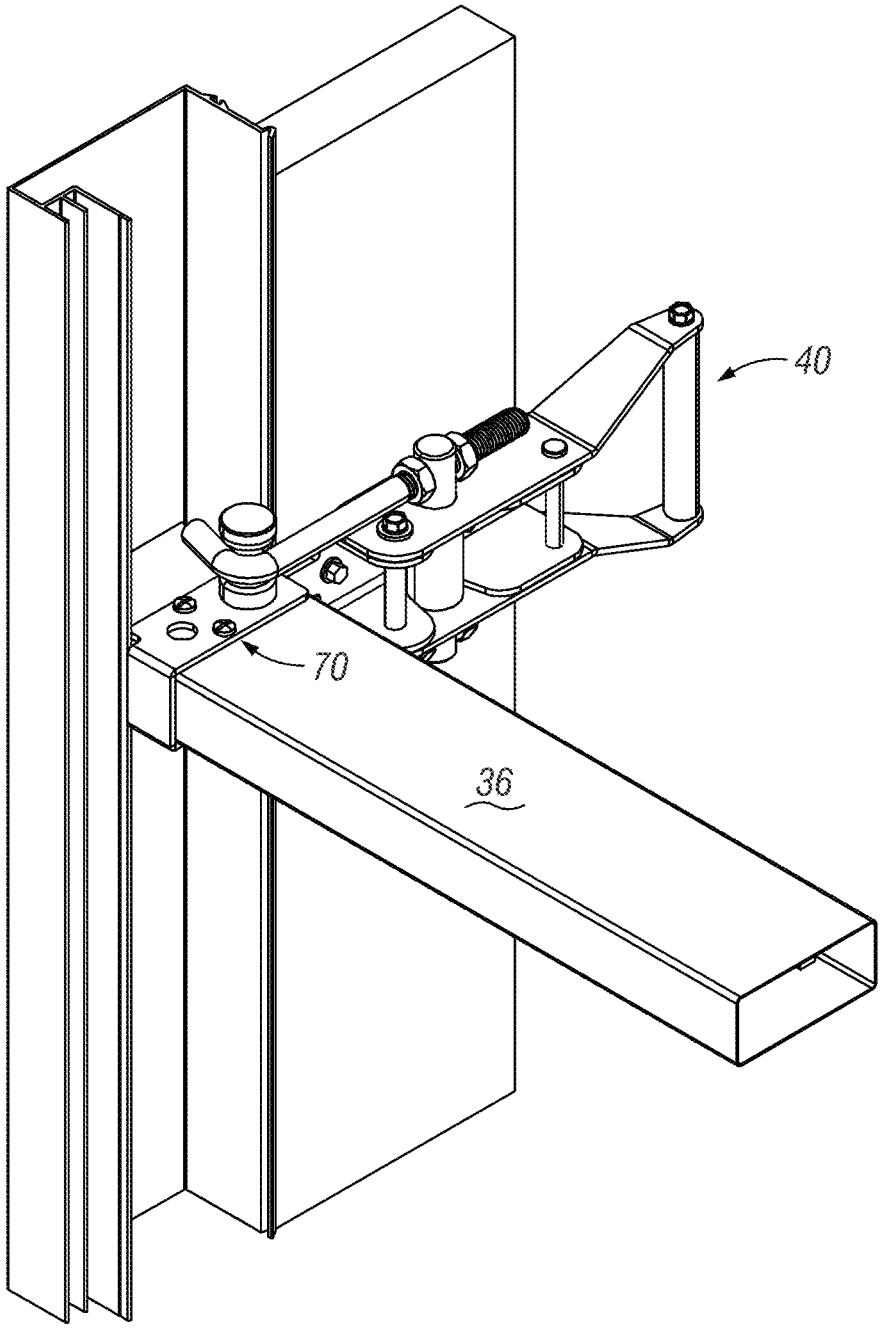
Figure 13:
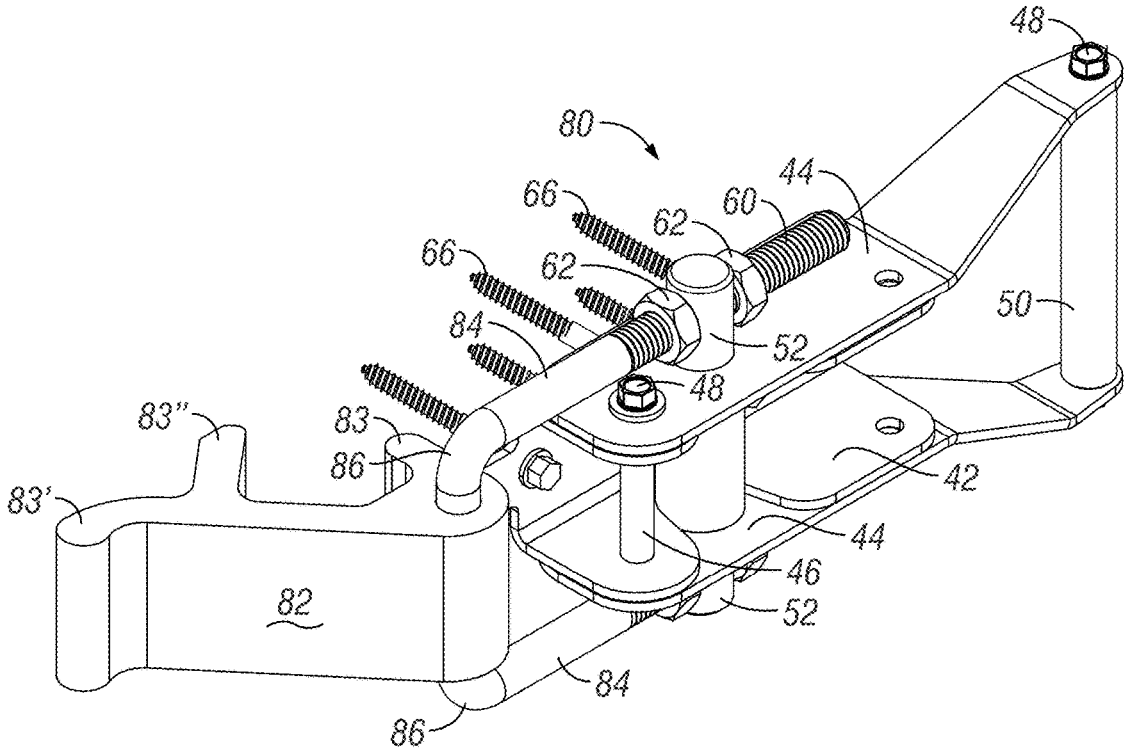
FIG. 13 shows a front, top perspective view of a heavy-duty jamb latch capable of engaging the interior of a vertical rail attached to a sliding building or structure door, according to some aspects of the present disclosure.
Figure 14:
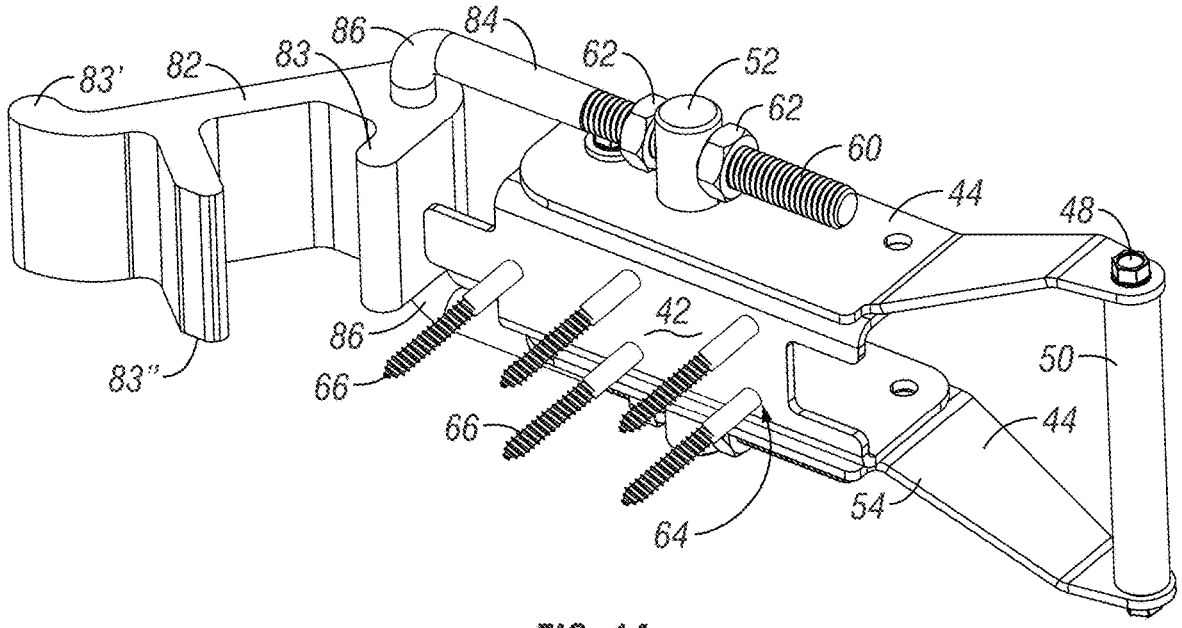
FIG. 14 shows a rear, top perspective view of the heavy-duty jamb latch of FIG. 13, according to some aspects of the present disclosure.
Figure 15:
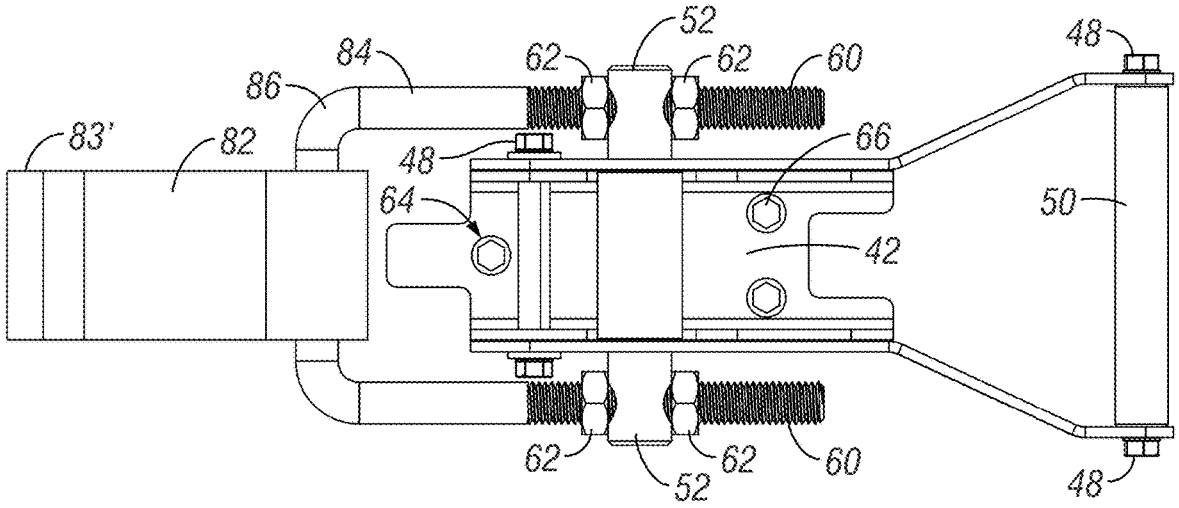
FIG. 15 shows a front elevation view of the heavy-duty jamb latch of FIG. 13, according to some aspects of the present disclosure.
Figure 16:
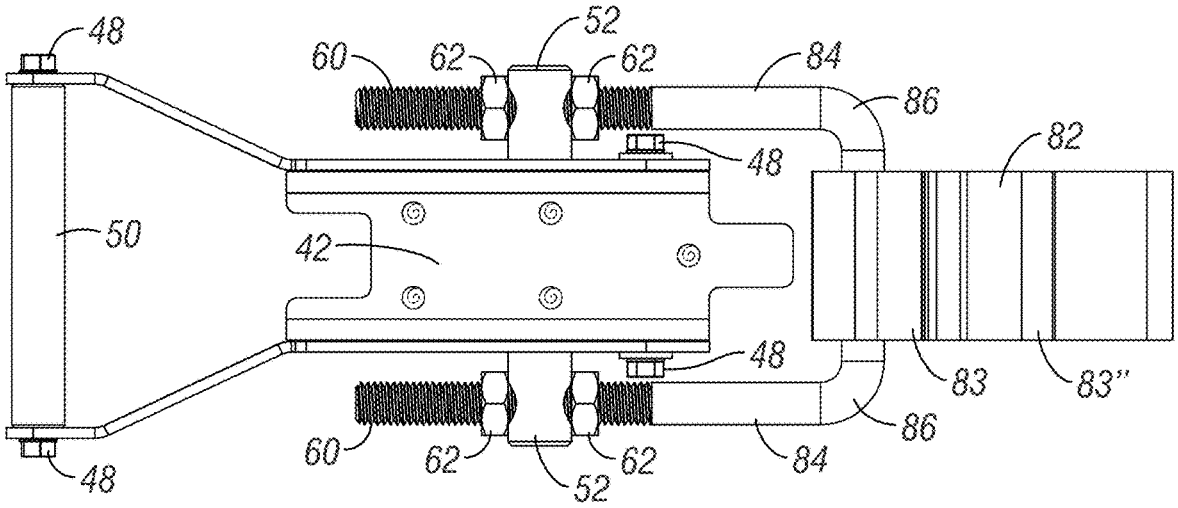
FIG. 16 shows a rear elevation view of the heavy-duty jamb latch of FIG. 13, according to some aspects of the present disclosure.
Figure 17:
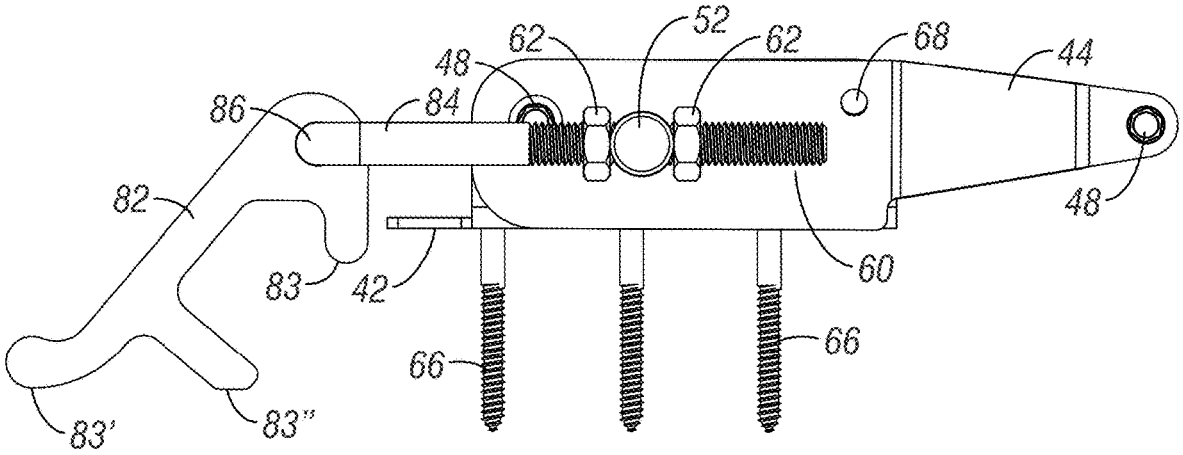
FIG. 17 shows a bottom elevation view of the heavy-duty jamb latch of FIG. 13, according to some aspects of the present disclosure.
Figure 18:
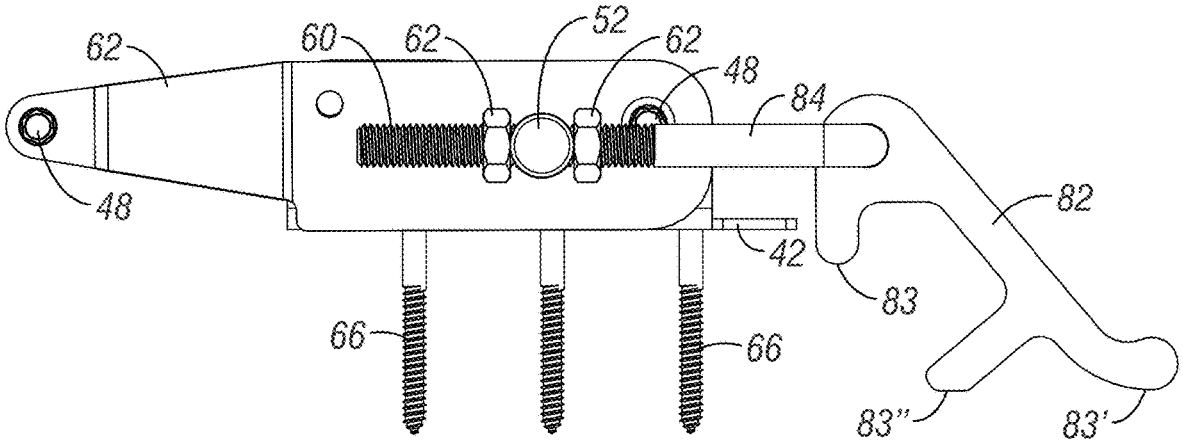
FIG. 18 shows a top elevation view of the heavy-duty jamb latch of FIG. 13, according to some aspects of the present disclosure.
Figure 19:
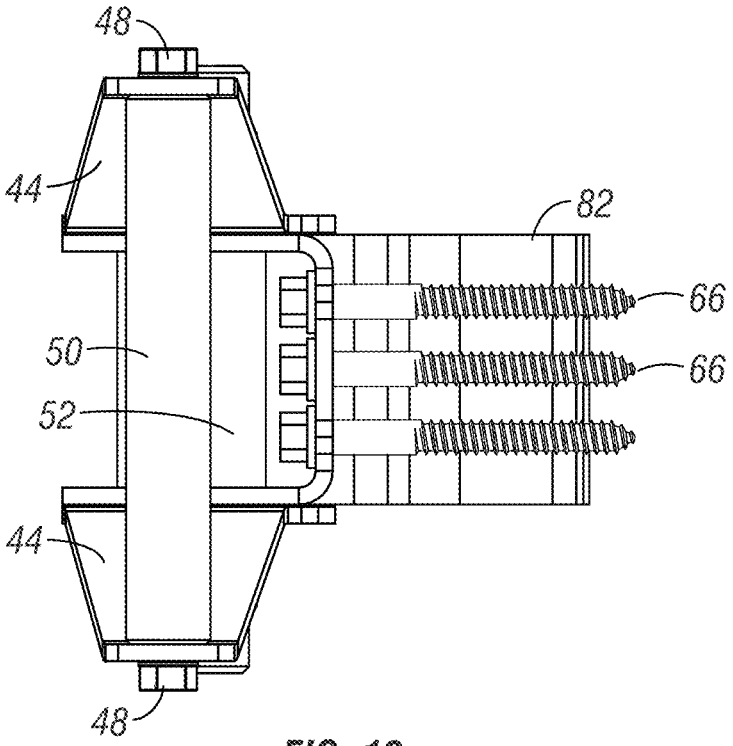
FIG. 19 shows a right elevation view of the heavy-duty jamb latch of FIG. 13, according to some aspects of the present disclosure.
Figure 20:
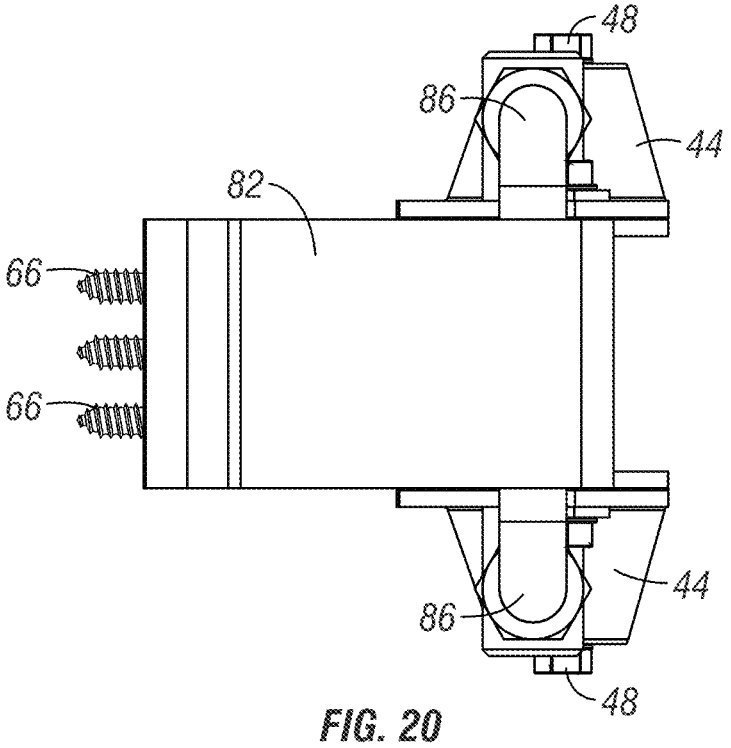
FIG. 20 shows a left elevation view of the heavy-duty jamb latch of FIG. 13, according to some aspects of the present disclosure.

A carrier pin 52 is positioned within recesses, cavities, or receptacles of the base plate 42 and passes through apertures in the side plates 44. In a preferred embodiment, the recesses, cavities, or receptacles may be aligned and the apertures in the side plates 44 may be aligned. The recesses in the base plate 42 may be substantially semi-circularly shaped or puzzle-pieced shaped such that movement of the carrier pin 52 is restricted from causing the side plates 44 from moving past a closed position wherein the side plates 44 are substantially parallel to the base plate 42 but is still free to move the carrier pin 52 out of the recesses of the base plate 42 when the side plates 44 pivot about the pivot pin 46 into an open position wherein the side plates 44 are substantially perpendicular to the base plate 42. Movement of the first exemplary heavy-duty jamb latch from an open position, to a partially open position, to a closed position is shown particularly in FIGS. 10 to 12 and causes the cam over mechanism (which for example may include rotational components such as the pivot pin 46, the carrier pin 52, etc.) to contact the side plates 44 and handle pin 50.

Hook-shaped struts 54 are removably fastened to the carrier pin 52 via bores drilled into the carrier pin 52, threads 60 in the hook-shaped struts 54, and nuts 62 tightened via the threads 60. The hook-shaped struts 54 are rigid members made of a heavy material and are designed to be easily installed and adjusted. Jamb latches known in the art however only have one rod made of a lighter material with a smaller diameter. According to a preferred embodiment, the hook-shaped struts 54 have an acute radial bend 56 and a hooked end 58. The hook-shaped struts 54 extend away from the handle pin 50 at the hooked end 58. The acute radial bend 56 and hooked end 58 allows the hook-shaped struts 54 to latch onto or wrap around two latching posts, pegs, knobs 72 which are secured to a mounting bracket assembly for a steel box girt or 2×4 wood lateral 70 via shafts or spokes 74 of the latching posts, pegs, or knobs. The shafts or spokes 74 may thread into each other through the mounting bracket assembly for a steel box girt or 2×4 wood lateral 70 and may comprise set screws, traditional threads, or a tapped hole. The mounting bracket assembly 70 may also be secured to one of the box girts or 2×4 wood laterals 37 of the sliding door 36 via box girt mounting bracket apertures 76 and a fastener, such as a flathead screw or bolt 78, as is particularly shown in FIGS. 2 and 12.

The first exemplary jamb latch 40 may be mounted to a jamb 38 of the frame 39 of the building or structure via openings 64 in the base plate and fasteners, such as lag screws 66, creating more stability for the first exemplary jamb latch 40.

The present disclosure also contemplates any other known members capable of protruding from a surface and retaining the hook-shaped strut 54 may be used in lieu of latching posts, pegs, or knobs 74 and that any other known fastener may be used in lieu of lag screws 66.

Finally, locking pin or padlock 68 may lock the first exemplary heavy-duty jamb latch 40 via pin holes in the side plates 44 and the base plate 42 when the first exemplary heavy-duty jamb latch 40 is in the closed position to provide additional security to the owner of possessions kept within a building or structure 35. In a preferred embodiment, the pin holes may be aligned.

Now referring to FIGS. 13 to 20 a similar, second exemplary heavy-duty jamb latch 80 includes several similar or identical components as the first exemplary heavy-duty jamb latch 40. The primary difference between the first heavy-duty jamb latch 40 and the second heavy-duty jamb latch 80 is the use of a boot or shoe and orthogonal rods 84 in lieu of a box girt mounting bracket 70 and hook-shaped struts 54 to secure sliding doors to a rough opening of a building or structure. The orthogonal rods 84 have a normal (approximately ninety-degree) bend 86.

The boot or shoe is preferably made of approximately two-inch-thick aluminum, steel, or plastic and relies on three points of contact to engage and lock a vertical rail which has been mounted to the end of the jamb 38. Optionally, a small hole (not shown) may be drilled through the side of the aluminum boot or shoe. In such an embodiment, a steel slotted spring pin may be pressed into the hole to help retain upward and downward movement of the boot.

Figure 21A:
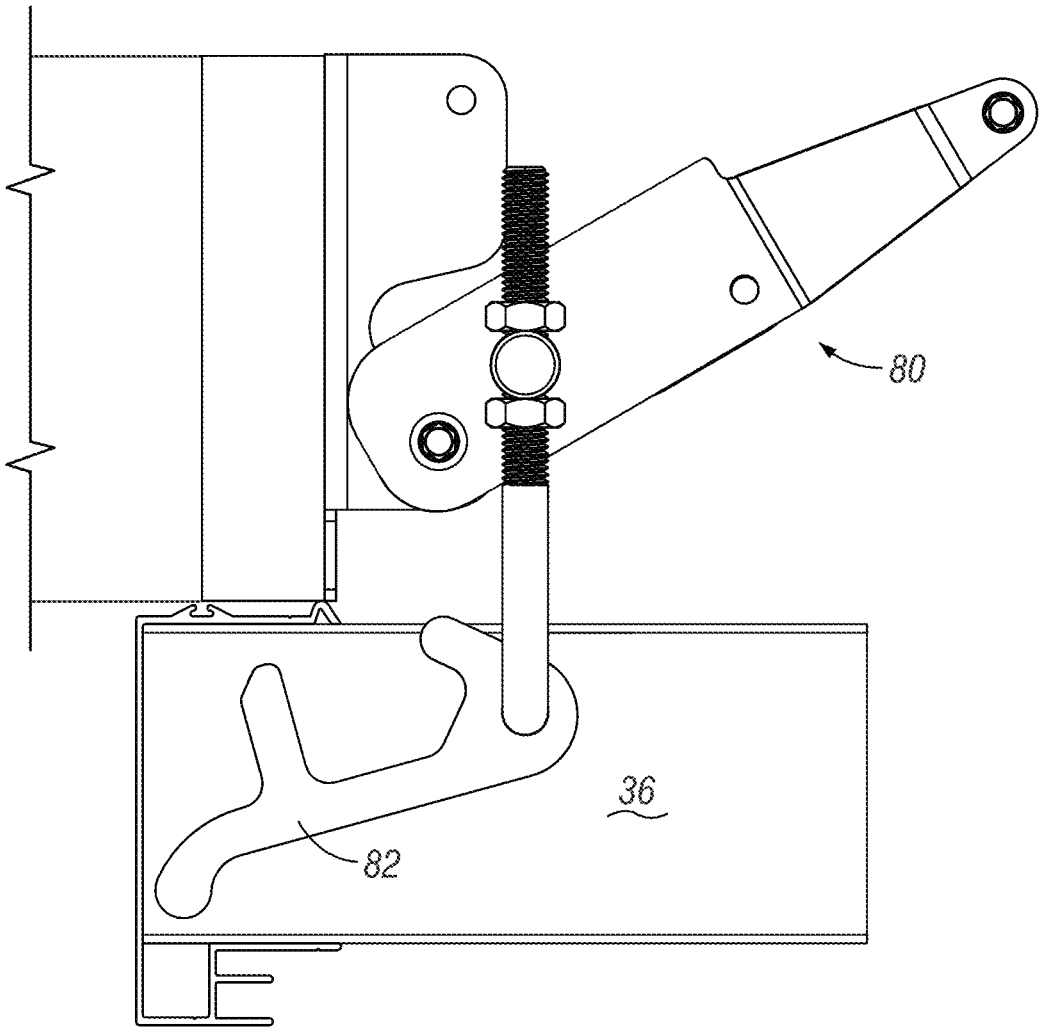
FIGS. 21A and 21B show a top elevation view and a top, front perspective view of the heavy-duty jamb latch of FIG. 13 in an open position and about to engage the interior of a vertical rail attached to a sliding building or structure door, according to some aspects of the present disclosure.
Figure 21B:
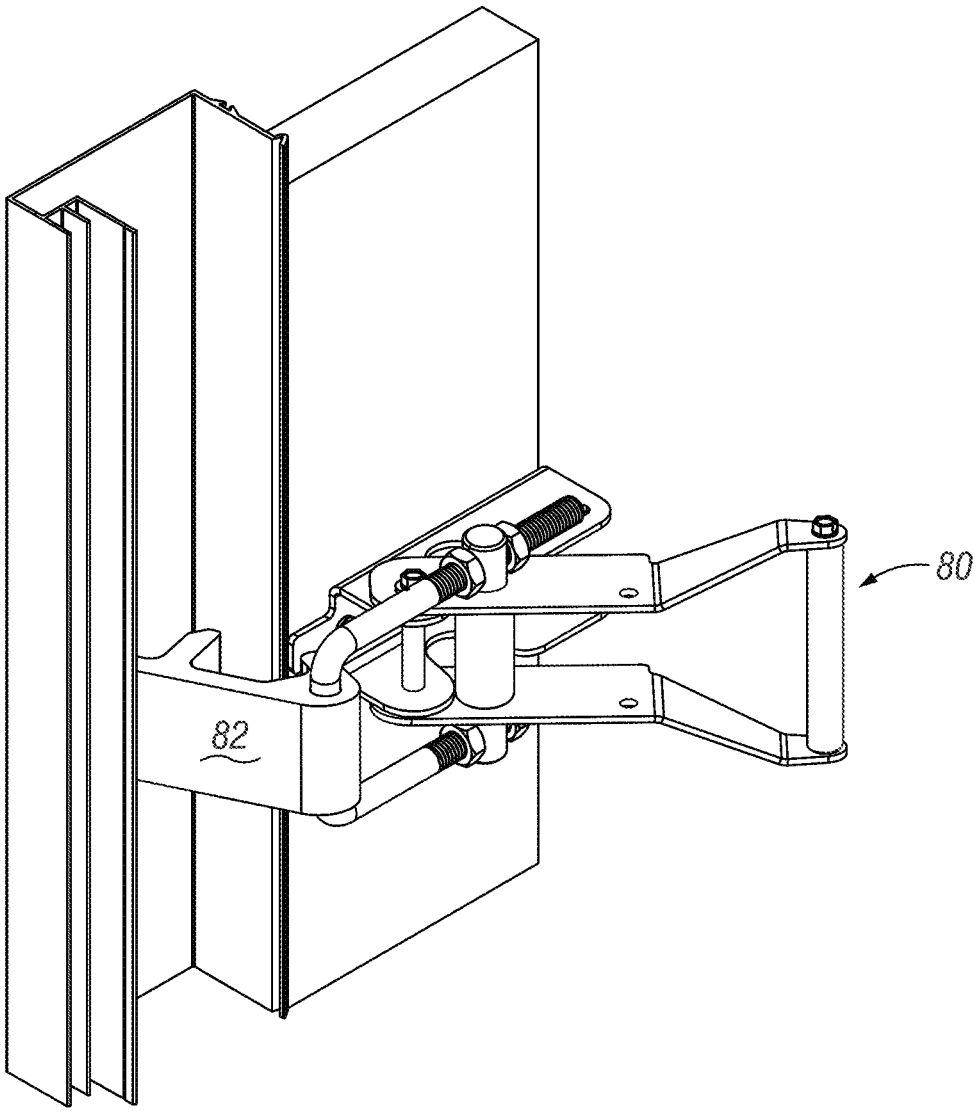
Figure 22A:
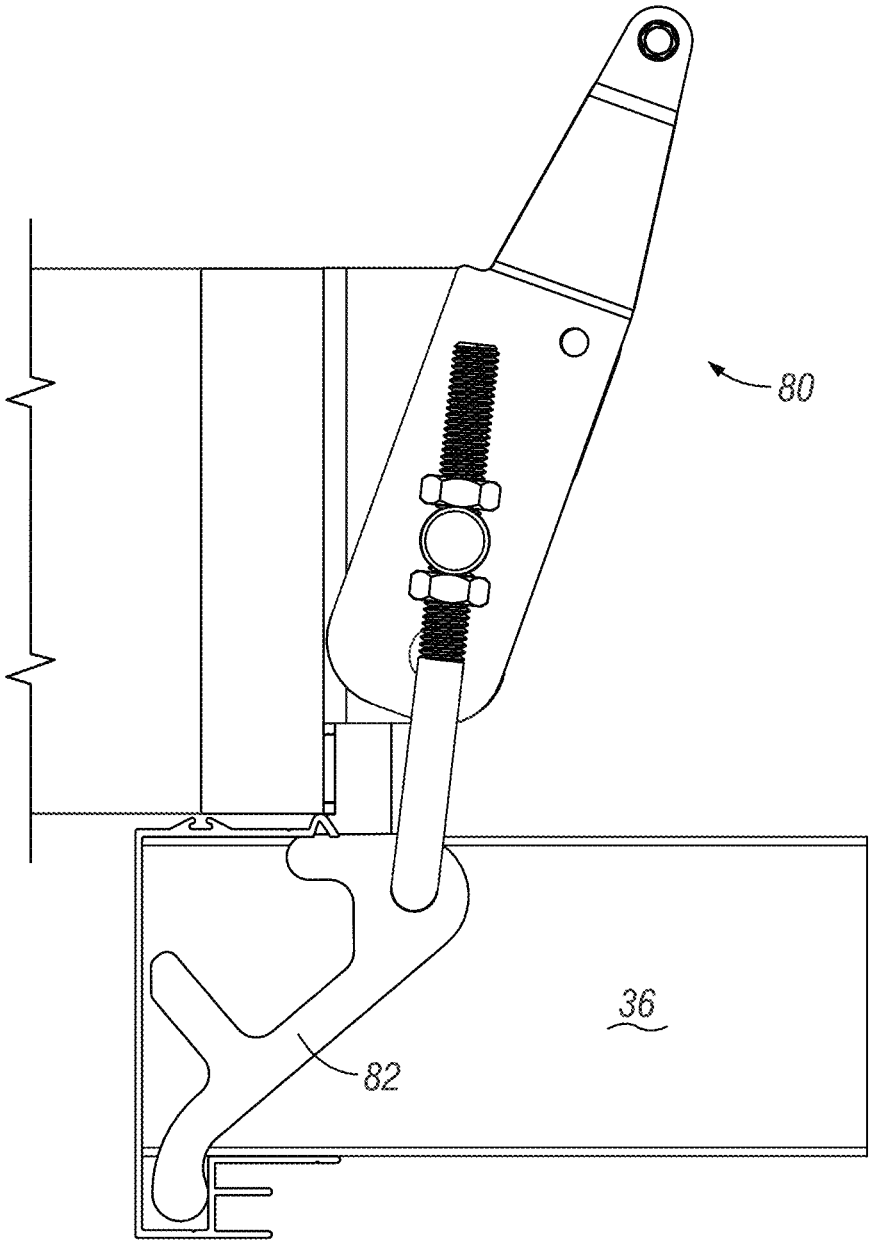
FIGS. 22A and 22B show a top elevation view and a top, front perspective view of the heavy-duty jamb latch of FIG. 13 in a partially open position and engaging the interior of a vertical rail attached to a sliding building or structure door, according to some aspects of the present disclosure.
Figure 22B:
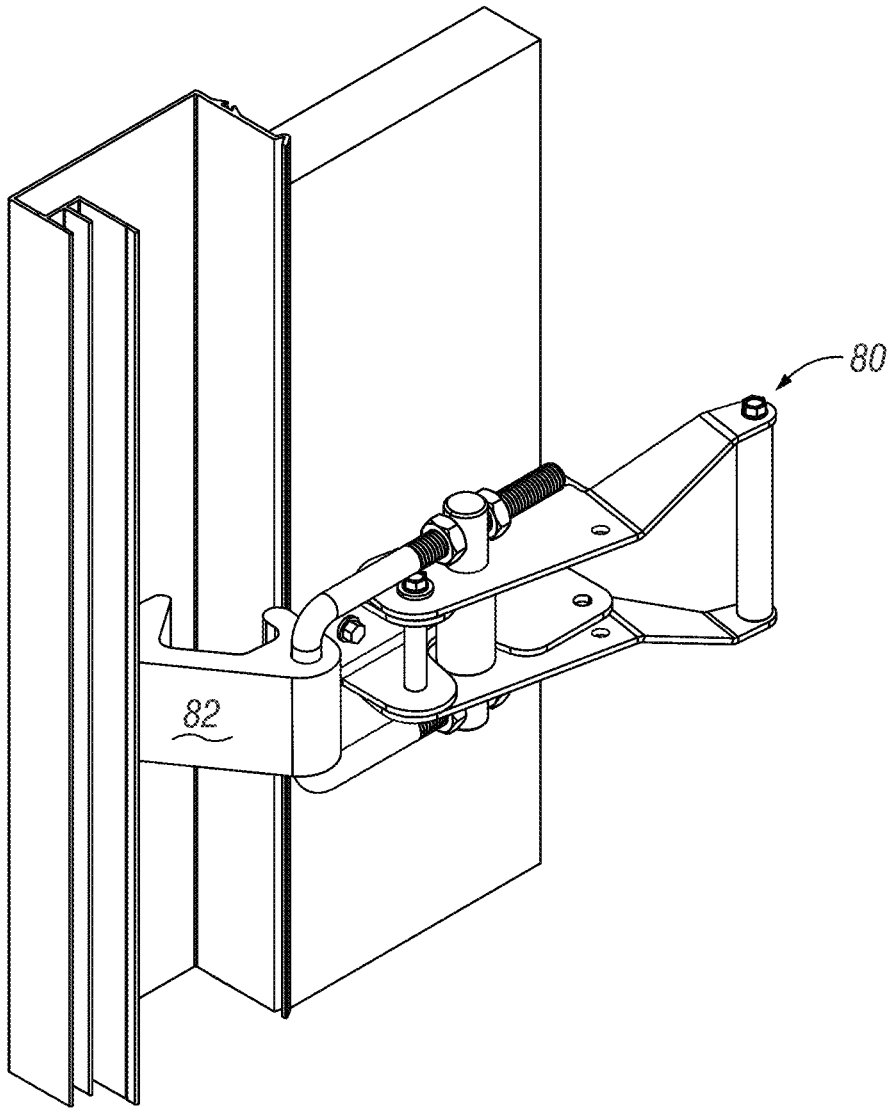
Figure 23A:
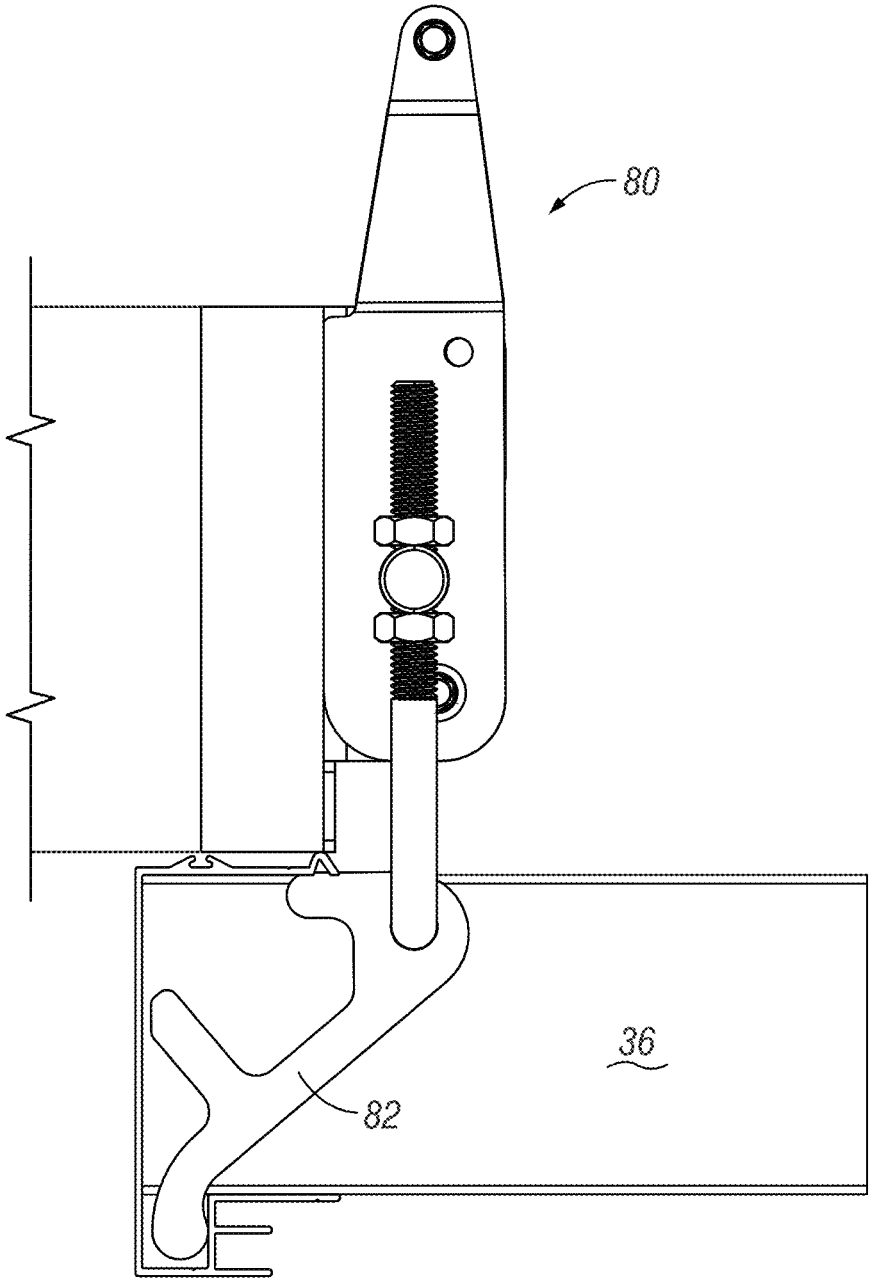
FIGS. 23A and 23B show a top elevation view and a top, front perspective view of the heavy-duty jamb latch of FIG. 13 in a closed position and engaging the interior of a vertical rail attached to a sliding building or structure door, according to some aspects of the present disclosure.
Figure 23B:
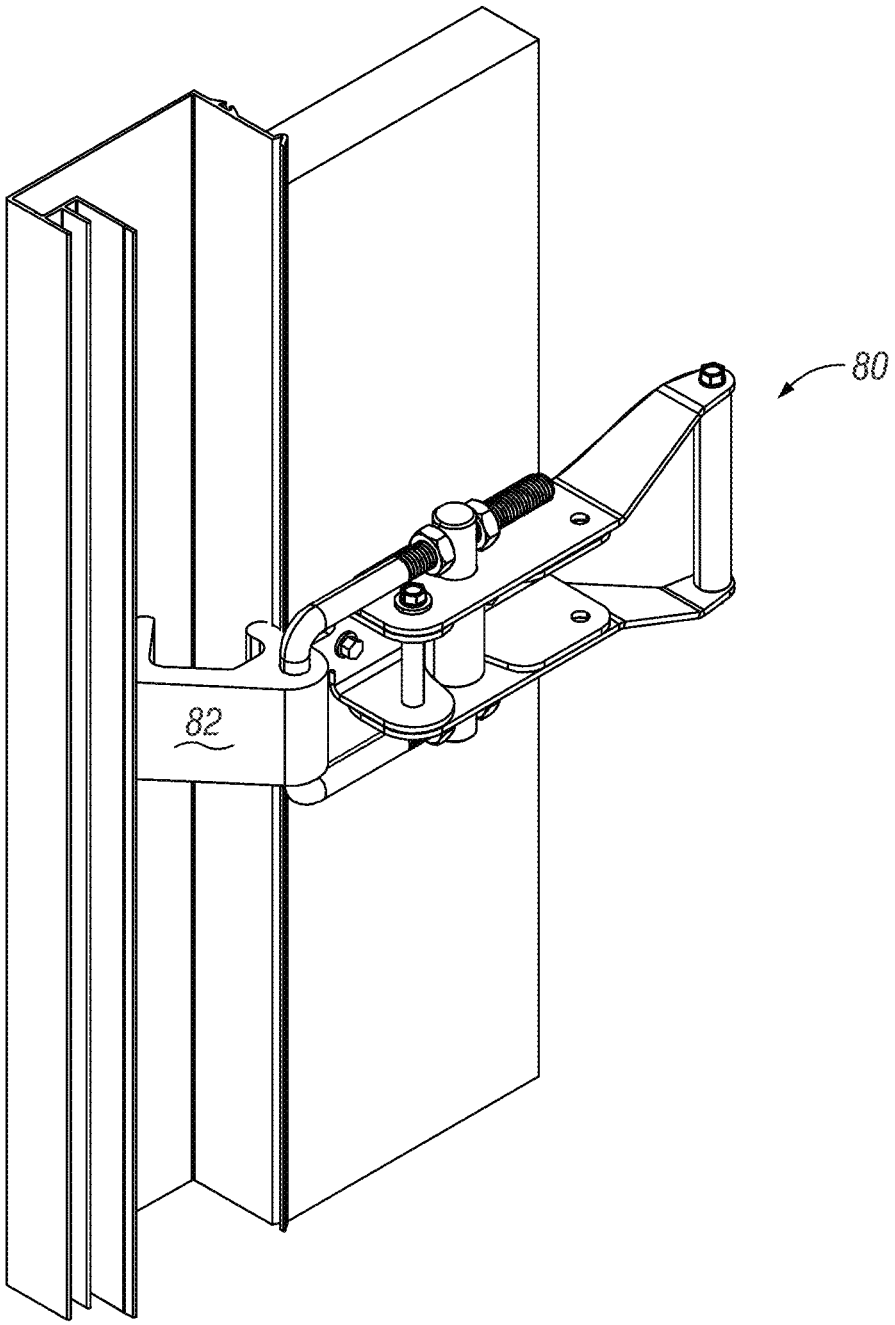

During locking (as particularly seen in FIGS. 21 to 23), the second exemplary heavy-duty jamb latch 80 moves from an open position, to a partially open position, to a closed position. The first point of contact occurs on an inner surface of the vertical rail. The second point of contact occurs at a rear surface of the vertical rail that is perpendicular to the inner surface of the vertical rail. Finally, the third point of contact is within an interior alcove of the vertical rail at the corner of the rear surface and an outer surface and is located behind two flanges configured to receive door metal cladding. The three points of contact help disperse the increased load of the door in two dimensions and improve the durability of the boot or shoe.

Now referring to FIGS. 24 to 34, individual exemplary components of the heavy-duty jamb latches 40, 80 are shown.

Figure 24A:
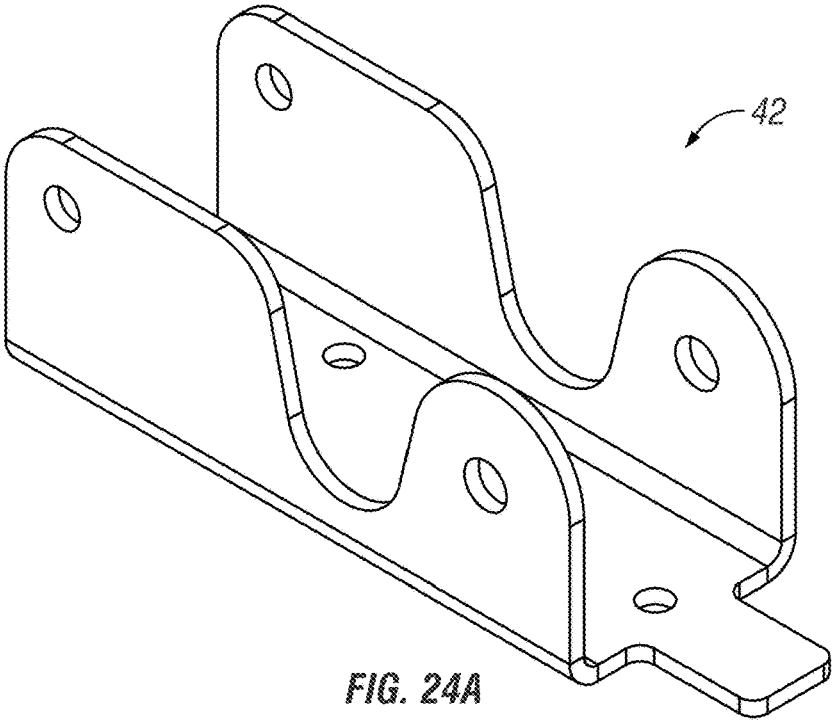
FIGS. 24A, 24B, and 24C show a top, front, and right-side perspective view, a top elevation view, and a front elevation view of a base plate for the heavy-duty jamb latch of FIGS. 2 and 13, according to some aspects of the present disclosure.
Figure 24B:
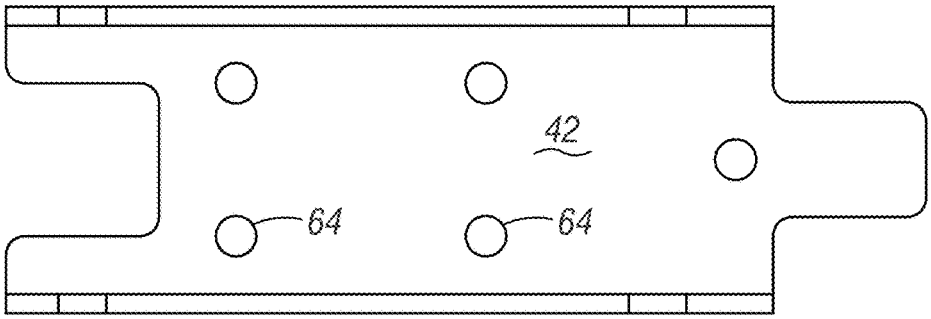
Figure 24C:
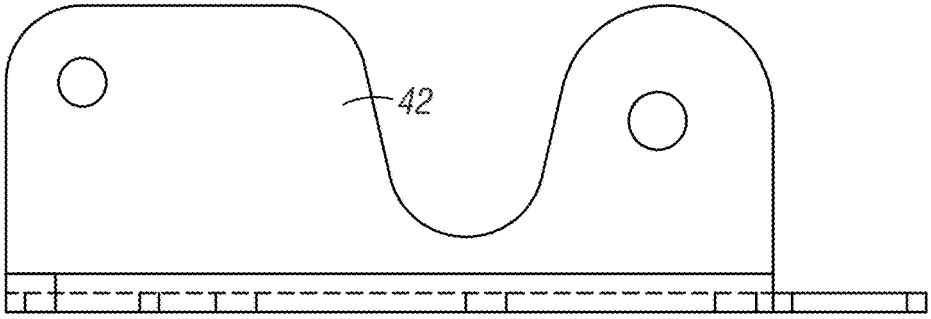

FIG. 24 shows a base plate 42 of the first and second exemplary heavy-duty jamb latches 40, 80 according to some aspects of the present disclosure. According to a non-limiting example, the base plate 42 may be polygonal in nature. The diameter of the openings 64 for mounting the heavy-duty jamb latch must be large enough to accommodate the lag screws 66 but not too large so as to lose a friction fit with the lag screws 66. There may be five openings 64 symmetrically placed around the base plate 42. The base plate 42 may further include locating features or extensions 43 to allow for easier installation of the heavy-duty jamb latch onto the rough opening 39 of the building or structure. The corners of the base plate may be rounded to prevent operators of the first and second exemplary heavy-duty jamb latches 40, 80 from injuring themselves.

Figure 25A:
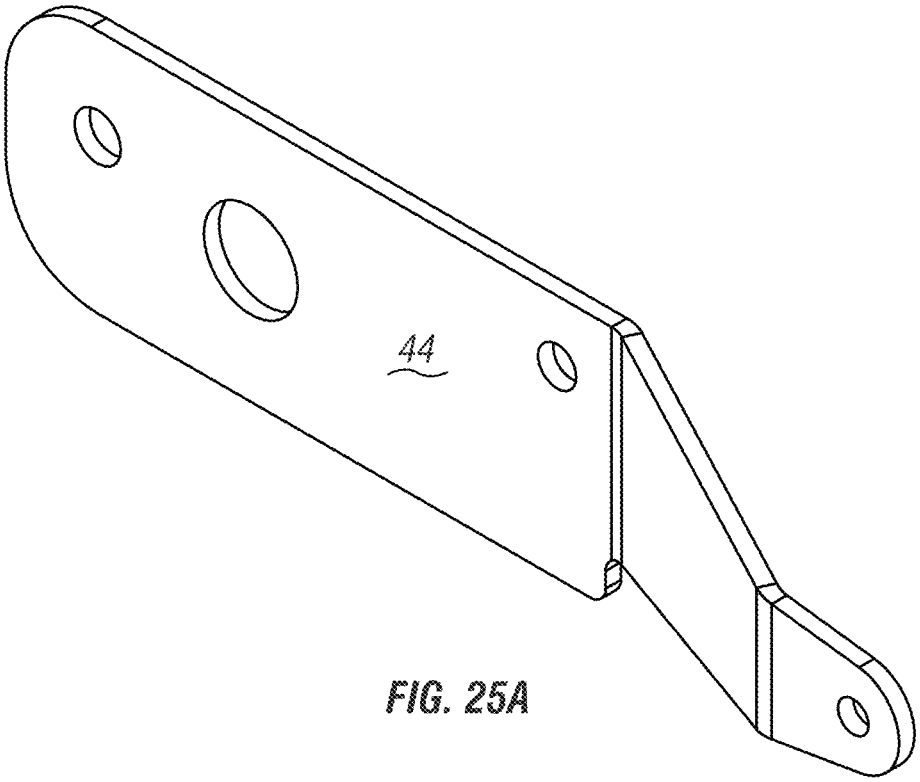
FIGS. 25A, 25B, and 25C show a top, front, and right-side perspective view, a front elevation view, and a top elevation view of a side plate for the heavy-duty jamb latch of FIGS. 2 and 13, according to some aspects of the present disclosure.
Figure 25B:
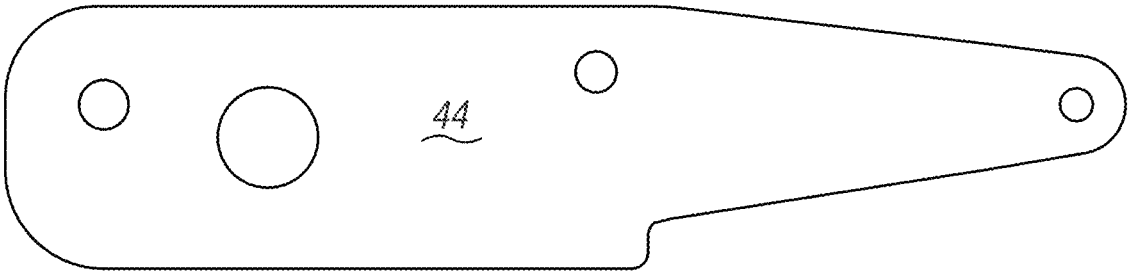
Figure 25C:
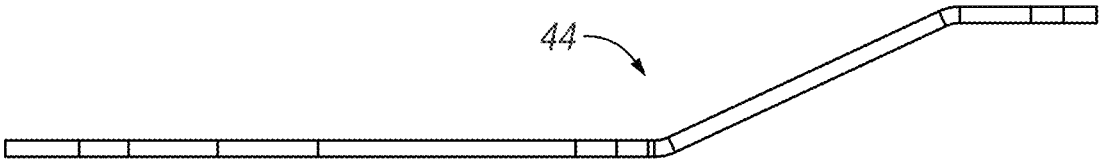

FIG. 25 shows a side plate 44 of the first and second exemplary heavy-duty jamb latch 40, 80 according to some aspects of the present disclosure. According to a non-limiting example, the main face of the side plate 44 may be substantially rectangular in nature and may have rounded corners. The diameter of the opening which receives the carrier pin 52 must be large enough to accommodate the carrier pin 52 but not too large so as to lose a friction fit with the carrier pin 52. The openings which receive the pivot pin 46, the locking pin or padlock 68, and handle pin 50 are typically smaller than the opening which receives the carrier pin 52 and may be similarly sized so that identical fasteners, such as hexagonal screws 48, may be used to secure the pivot pin 46, the locking pin or padlock 68, and handle pin 50. The side plate 44 may further include a recessed surface that recesses outwardly at an angle. The recessed surface may also be trapezoidal shaped, the upper edge of which may slope downward at an angle and the lower edge of which may slope upward at an angle. The "attaching" surface includes the opening for the fastener, such as a hexagonal screw 48, that secures the handle pin 50 and essentially extends the upper and lower edges of the recessed surface into a rounded nose cone shape.

Figure 26A:
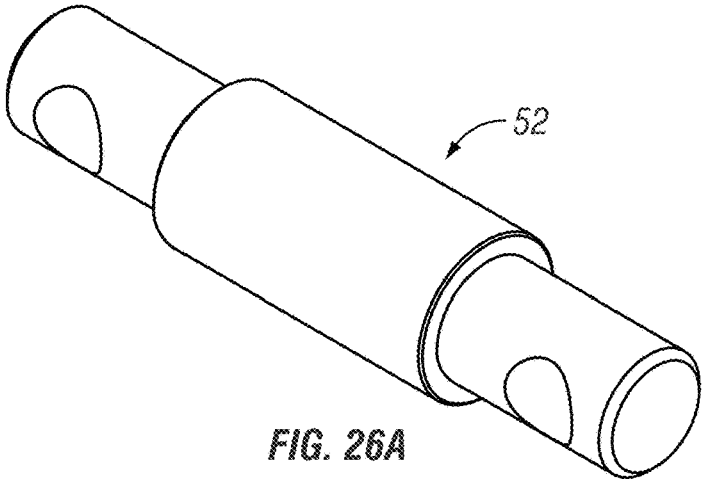
FIGS. 26A and 26B show a top, front, and right-side perspective view and a side elevation view of a carrier pin for the heavy-duty jamb latch of FIGS. 2 and 13, according to some aspects of the present disclosure.
Figure 26B:
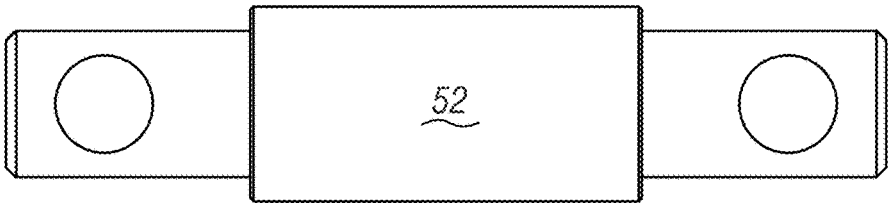

FIG. 26 shows a carrier pin for the first and second exemplary heavy-duty jamb latch 40, 80 according to some aspects of the present disclosure. According to a non-limiting example, the carrier pin 52 is essentially "a pin within a pin." The carrier pin 52 may comprise one piece, two pieces (a rod and a sleeve), or three pieces (a main portion and two cylindrical ends). For the purposes of presenting exemplary dimensions, the three piece system will be discussed. The main portion of the carrier pin 52 (i.e. the portion of the carrier pin that is placed between the side plates 44) has a diameter larger than the diameter of the cylindrical ends of the carrier pin 52. The cylindrical ends of the carrier pin 52 are substantially identical. The bores within the cylindrical ends of the carrier pin 52 have a diameter large enough to accommodate the rods or struts 54, 84 but not too large so as to lose a friction fit with the rods or struts 54, 84. The centers of the bores are offset from the outward surface of the cylindrical ends a distance. The edge at the outward surface of the cylindrical ends may include a fillet or a chamfer.

Figure 27A:
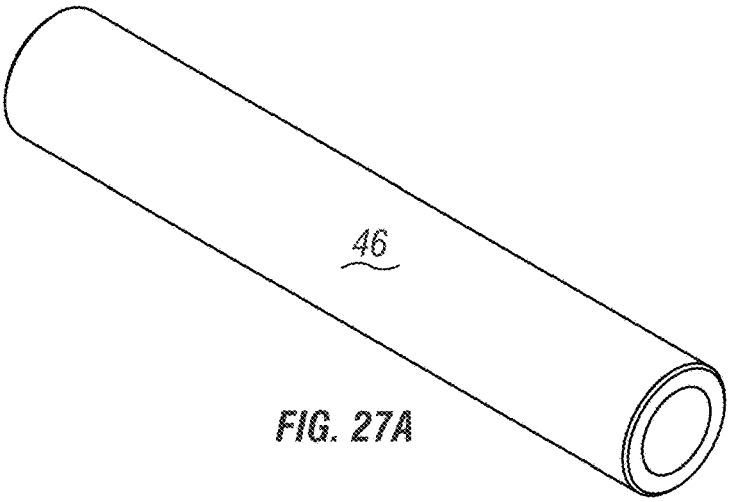
FIGS. 27A, 27B, and 27C show a top, front, and right-side perspective view, a side plan view, and an end plan view of a pivot pin for the heavy-duty jamb latch of FIGS. 2 and 13, according to some aspects of the present disclosure.
Figure 27B:
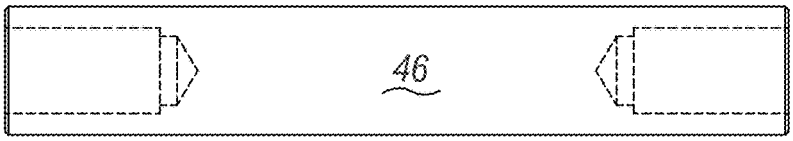
Figure 27C:
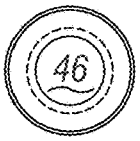

FIG. 27 shows a pivot pin 46 for the first and second exemplary heavy-duty jamb latch 40, 80 according to some aspects of the present disclosure. According to a non-limiting example, the pivot pin 46 has screw holes for the fasteners, such as hexagonal screws 48, at each end of the pivot pin 46.

Figure 28A:
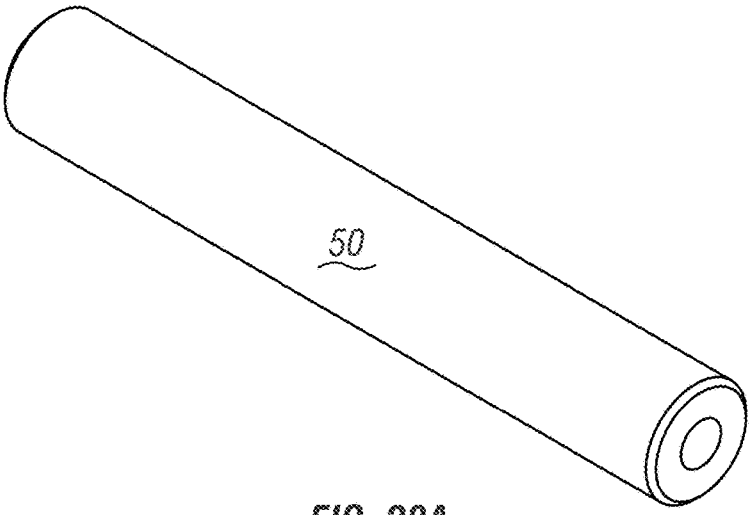
FIGS. 28A, 28B, and 28C show a top, front, and right-side perspective view, a side plan view, and an end plan view of a handle pin for the heavy-duty jamb latch of FIGS. 2 and 13, according to some aspects of the present disclosure.
Figure 28B:
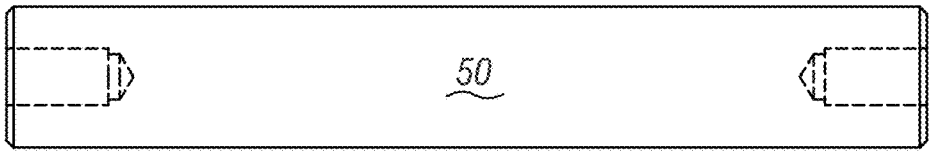
Figure 28C:
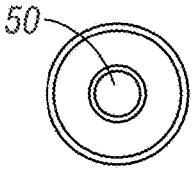

FIG. 28 shows a handle pin 50 for the first and second exemplary heavy-duty jamb latch 40, 80 according to some aspects of the present disclosure. According to a non-limiting example, the handle pin 50 has screw holes for the fasteners, such as hexagonal screws 48, at each end of the handle pin 50.

Figure 29:
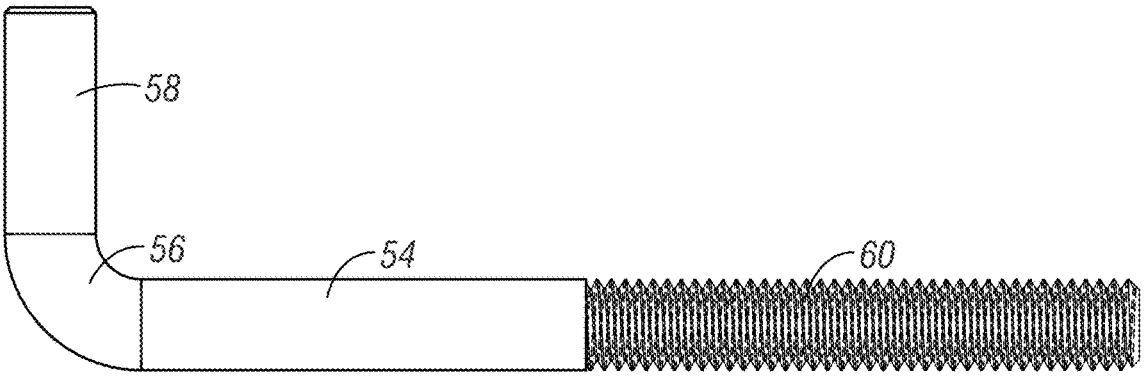
FIG. 29 shows a top elevation view of an about ninety-degree rod for the heavy-duty jamb latch of FIG. 13, according to some aspects of the present disclosure.

FIG. 29 shows an approximately ninety-degree rod 84 for the second exemplary heavy-duty jamb latch 80 according to some aspects of the present disclosure. According to a non-limiting example, the orthogonal rod 84 has a radial bend 86 having an inner radius and an outer radius, the inner radius being smaller than the outer radius. The threads 60 must be sized such that the can be used in combination with nuts 62.

Figure 30A:
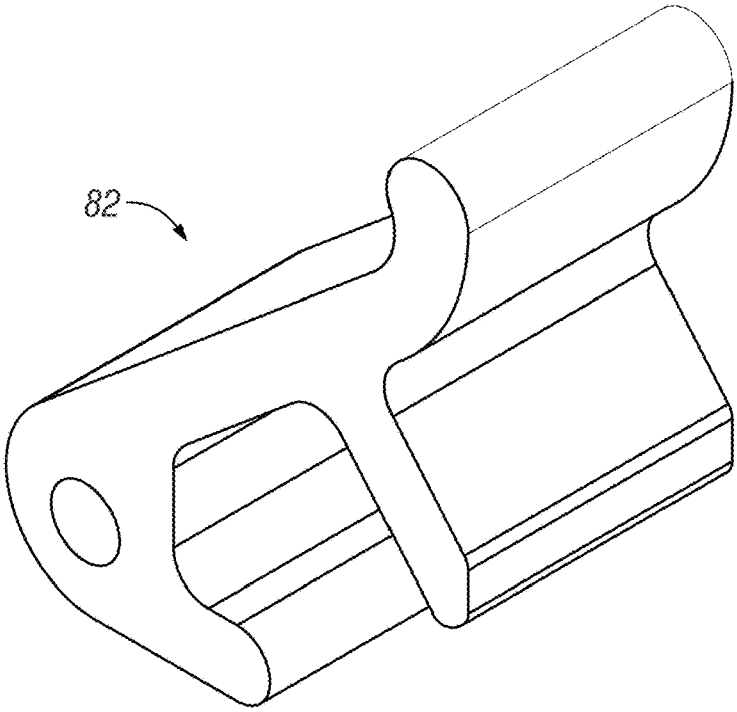
FIGS. 30A, 30B, and 30C show a top, rear, and left-side perspective view, a front elevation view, and a side elevation view of a shoe or boot for the heavy-duty jamb latch of FIG. 13, according to some aspects of the present disclosure.
Figure 30B:
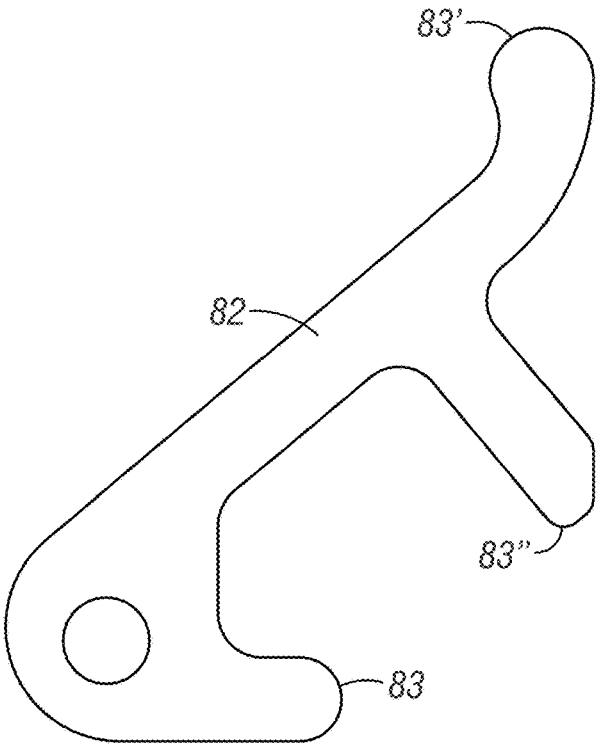
Figure 30C:
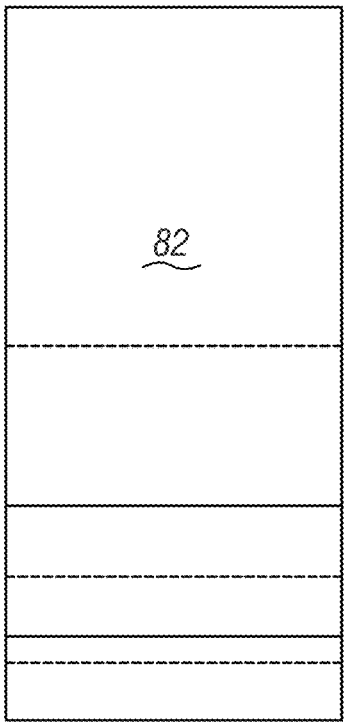

FIG. 30 shows a shoe or boot for the second exemplary heavy-duty jamb latch 80 according to some aspects of the present disclosure. According to a non-limiting example, the shoe or boot has three bridge supports 83, 83', 83" which serve as the three points of contact. The bridge 82 of the boot (which attaches to the bridge supports) extends away from the first bridge support 83 at an angle into the second bridge support 83'. The second bridge support 83' has a protrusion that bends upward to better engage the alcove of the vertical rail. Finally, the third bridge support 83" diverges from the second bridge support 83' at an approximately orthogonal angle. The overall height of the shoe or boot depends on the size of the vertical rail (including the alcove within the vertical rail). Increasing the overall thickness of the shoe or boot typically increases the strength of the shoe or boot. Finally, the overall width of the boot or shoe depends on the angles at which the bridge supports 83, 83', 83" diverge from the bridge 82.

Figure 31A:
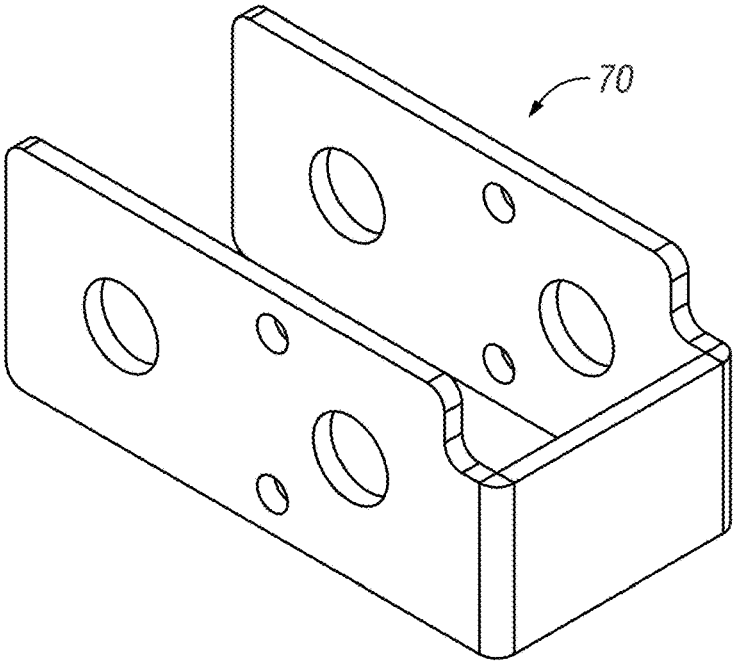
FIGS. 31A, 31B, and 31C show a top, rear, and left-side perspective view, a front elevation view, and a side elevation view of a box girt mounting bracket for the heavy-duty jamb latch of FIG. 2, according to some aspects of the present disclosure.
Figure 31B:
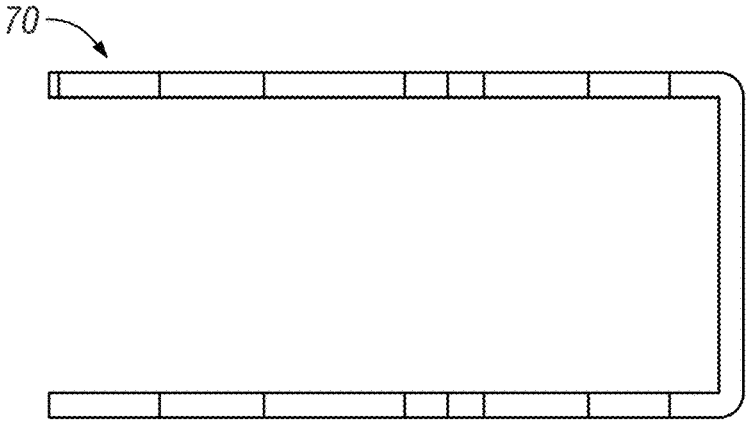
Figure 31C:
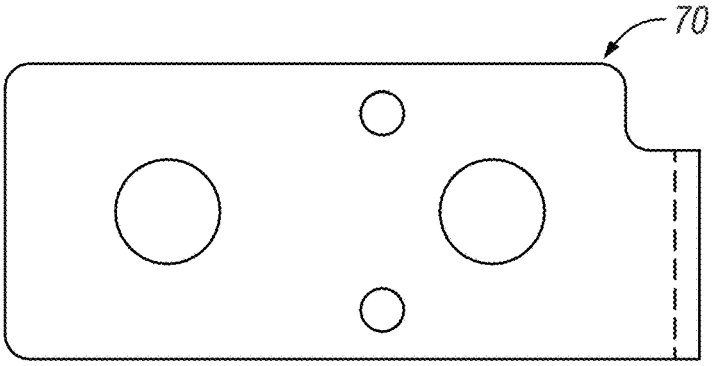

FIG. 31 shows a box girt mounting bracket 70 for the first exemplary heavy-duty jamb latch 40 according to a non-limiting example and some aspects of the present disclosure.

Figure 32A:
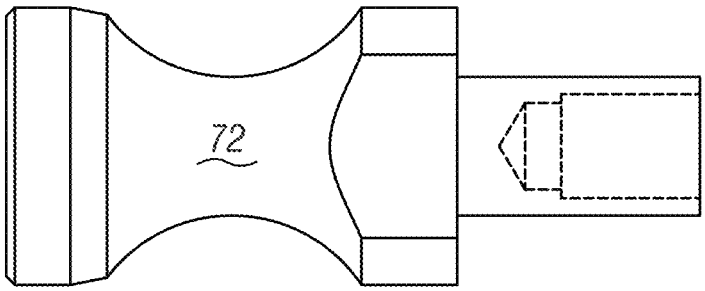
FIGS. 32A and 32B show a front plan view and a top plan view of a latching post, peg, or knob with a set screw for the heavy-duty jamb latch of FIG. 2, according to some aspects of the present disclosure.
Figure 32B:
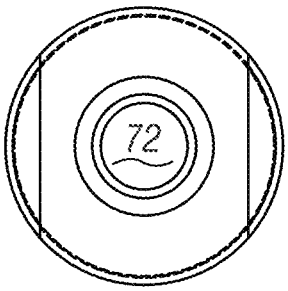
Figure 33A:
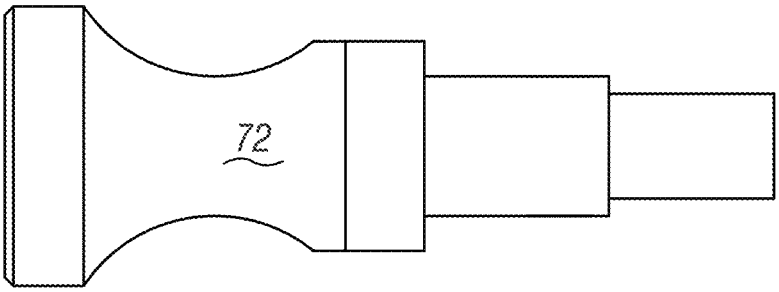
FIGS. 33A and 33B show a front plan view and a top plan view of a latching post, peg, or knob with threads for the heavy-duty jamb latch of FIG. 2, according to some aspects of the present disclosure.
Figure 33B:
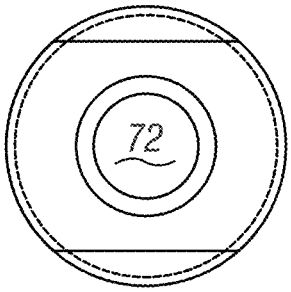
Figure 34A:
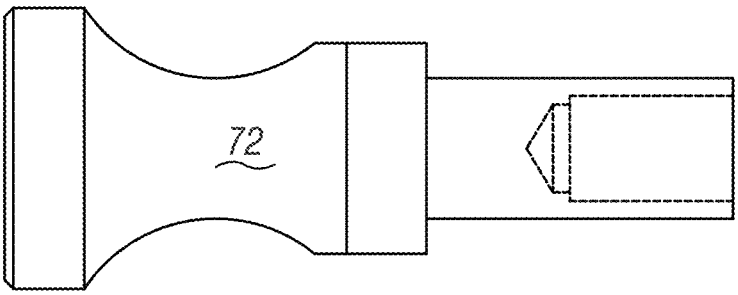
FIGS. 34A and 34B show a front plan view and a top plan view of a latching post, peg, or knob with a tapped hole for the heavy-duty jamb latch of FIG. 2, according to some aspects of the present disclosure.
Figure 34B:
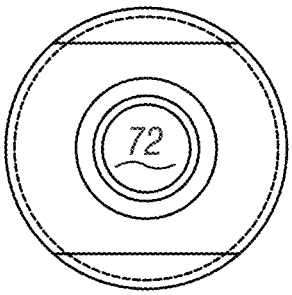

FIGS. 32 to 34 show several different latching posts, pegs, or knobs 72 for the first exemplary heavy-duty jamb latch 40 according to non-limiting examples and several aspects of the present disclosure. For example, FIG. 32 shows the latching post, peg, or knob 72 with a set screw for the heavy-duty jamb latch; FIG. 33 shows the latching post, peg, or knob 72 with threads for the heavy-duty jamb latch; and FIG. 34 shows the latching post, peg, or knob 72 with a tapped hole for the heavy-duty jamb latch.

LIST OF REFERENCE NUMERALS

The following reference numerals are provided to facilitate an understanding of the present disclosure and are not an exhaustive list of every element contained within the present disclosure. Provided it is possible to do so, elements identified by numerals may be replaced or used in combination with any elements identified by a separate numeral. Additionally, numerals are not limited to the descriptors provided herein and include equivalent structures and other objects possessing the same function and/or that perform the same function(s) in substantially the same way to obtain substantially the same result.

35 building or structure
36 sliding door
37 box girt
38 jamb
39 rough opening of a building or structure
40 first exemplary heavy-duty jamb latch
42 base plate
43 locating features or extensions
44 side plates
46 pivot pin
48 fasteners, such as hexagonal screws
50 handle pin or handle
52 carrier pin
54 hook-shaped strut
56 radial bend
58 hooked end
60 threads
62 nuts
64 openings for mounting the heavy-duty jamb latch
66 fasteners, such as a lag screw
68 locking pin or padlock
70 mounting bracket assembly for a steel box girt or 2×4 wood lateral
72 latching posts, pegs, or knobs
74 shafts or spokes of latching posts, pegs, or knobs
76 box girt mounting bracket apertures
78 fastener, such as a flathead screw or bolt
80 second exemplary heavy-duty jamb latch
82 bridge
83 bridge support
84 orthogonal (about ninety-degree) rod
86 normal bend The disclosure is not to be limited to the particular embodiments described herein. The previous detailed description is of a small number of embodiments for implementing the disclosure and is not intended to be limiting in scope. The following claims set forth a number of the embodiments of the disclosure with greater particularity.

What is claimed is:

1. A heavy-duty jamb latch, comprising:

a base plate;

a handle movable between an open position and a closed position;

side plates adjacent and pivotably connected to the base plate;

a carrier pin passing through recesses in the base plate and apertures in the side plates;

hook-shaped struts fastened to the carrier pin at locations external to the side plates, extending away from the handle, and configured to latch onto a mounting bracket assembly consisting of latching posts, pegs, or knobs used with steel box girts or 2×4 wood laterals; and a cam which allows the hook-shaped struts and the base plate to remain in substantially parallel relation while the handle moves from the open position to the closed position;

wherein the side plates are configured to be (i) substantially perpendicular to the base plate, the hook-shaped struts, and a jamb while the handle is in the open position and (ii) substantially parallel to the base plate, the hook-shaped struts, and the jamb while the handle is in the closed position.

2. The heavy-duty jamb latch of claim 1 wherein an acute radial bend of the hook-shaped struts allows the hook-shaped struts to wrap around the latching posts, pegs, or knobs of the mounting bracket assembly.

3. The heavy-duty jamb latch of claim 1 wherein threads in the hook-shaped struts and nuts fasten the hook-shaped struts to the carrier pin.

4. A combination comprising:

a mounting bracket assembly consisting of latching posts, pegs, or knobs;

a steel box girt or 2×4 wood lateral;

a heavy-duty jamb latch, comprising:

a base plate;

a handle;

side plates adjacent and pivotably connected to the base plate;

a carrier pin passing through recesses in the base plate and apertures in the side plates; and hook-shaped struts fastened to the carrier pin at locations external to the side plates, extending away from the handle, said hook-shaped struts configured to latch to the mounting bracket assembly to the steel box girt or 2×4 wood lateral.

5. A heavy-duty jamb latch, comprising:

a base plate;

a handle movable between an open position and a closed position;

side plates adjacent and pivotably connected to the base plate;

a carrier pin passing through recesses in the base plate and apertures in the side plates; and hook-shaped struts fastened to the carrier pin at locations external to the side plates via bores drilled into the carrier pin, extending away from the handle, and securing sliding doors to a rough opening of a building or structure;

a cam which allows the hook-shaped struts and the base plate to remain in substantially parallel relation while the handle moves from the open position to the closed position;

wherein the side plates are configured to be (i) substantially perpendicular to the base plate, the hook-shaped struts, and a jamb while the handle is in the open position and (ii) substantially parallel to the base plate, the hook-shaped struts, and the jamb while the handle is in the closed position.

6. The heavy-duty jamb latch of claim 5 in combination with a second heavy-duty jamb latch having substantially identical features, said combination used to further secure the sliding doors to the rough opening of the building or structure.

7. The heavy-duty jamb latch of claim 5 further comprising pin holes in the side plates and the base plate through which a locking pin or padlock is used to lock the heavy-duty jamb latch.

8. The heavy-duty jamb latch of claim 5 wherein the base plate further includes openings for mounting the heavy-duty jamb latch.

9. The heavy-duty jamb latch of claim 5 wherein the base plate further includes locating features or extensions to allow for easier installation of the heavy-duty jamb latch on to the rough opening of the building or structure.

10. The heavy-duty jamb latch of claim 5 wherein the handle comprises a handle pin removably attached to the side plates via screws.

11. A method of securing sliding doors to a rough opening of a building or structure, comprising:

providing a heavy-duty jamb latch having a base plate, a handle movable between an open position and a closed position, side plates adjacent and pivotably connected to the base plate, and a carrier pin passing through recesses in the base plate and apertures in the side plates;

employing a cam to allow hook-shaped struts of the heavy-duty jamb latch and the base plate to remain in substantially parallel relation while the handle moves from the open position to the closed position;

wherein the hook-shaped struts are fastened to the carrier pin at locations external to the side plates;

wherein the side plates are configured to be (i) substantially perpendicular to the base plate, the hook-shaped struts, and a jamb while the handle is in the open position and (ii) substantially parallel to the base plate, the hook-shaped struts, and the jamb while the handle is in the closed position;

securing the sliding doors to the rough opening of the building or structure with rigid members of the heavy-duty jamb latch, said rigid members fastened to the carrier pin via bores drilled into the carrier pin and extending away from the handle.

12. The method of claim 11 further comprising locking the heavy-duty jamb latch with a locking pin or a padlock via pin holes in the side plates and the base plate.

13. The method of claim 11 further comprising mounting the heavy-duty jamb latch to the rough opening of the building or structure.

14. The method of claim 11 wherein securing the heavy-duty jamb latch comprises moving the handle from an open position to a closed position which causes the side plates to pivot about the base plate.

15. The method of claim 14 wherein the side plates are substantially perpendicular to the base plate in the open position and the side plates are substantially parallel to the base plate in the closed position.

16. The heavy-duty jamb latch of claim 1 wherein the base plate includes opposing sides parallelly oriented.

17. The heavy-duty jamb latch of claim 16 wherein the side plates are mounted so as to substantially overlap the opposing sides of the base plate.

18. The heavy-duty jamb latch of claim 17 wherein the side plates are positioned external to the opposing sides of the base plate.

19. The heavy-duty jamb latch of claim 1 wherein a pivot pin pivotably connects at least two of the side plates and the base plate, the base plate includes an extension, and the handle attaches to at least two of the side plates.

* * * * *